US011466657B2

(12) United States Patent
Ohata

(10) Patent No.: US 11,466,657 B2
(45) Date of Patent: Oct. 11, 2022

(54) CONTROL DEVICE FOR INTERNAL COMBUSTION ENGINE

(71) Applicant: Hitachi Astemo, Ltd., Hitachinaka (JP)

(72) Inventor: Eiichirou Ohata, Hitachinaka (JP)

(73) Assignee: Hitachi Astemo, Ltd., Hitachinaka (JP)

( * ) Notice: Subject to any disclaimer, the term of this patent is extended or adjusted under 35 U.S.C. 154(b) by 0 days.

(21) Appl. No.: 17/287,931

(22) PCT Filed: Oct. 4, 2019

(86) PCT No.: PCT/JP2019/039248
§ 371 (c)(1),
(2) Date: Apr. 22, 2021

(87) PCT Pub. No.: WO2020/085042
PCT Pub. Date: Apr. 30, 2020

(65) Prior Publication Data

US 2021/0396201 A1 Dec. 23, 2021

(30) Foreign Application Priority Data

Oct. 24, 2018 (JP) ..... JP2018-200063

(51) Int. Cl.
*F02P 5/15* (2006.01)
*F02P 3/02* (2006.01)
(Continued)

(52) U.S. Cl.
CPC ..... *F02P 5/1502* (2013.01); *F02P 3/02* (2013.01); *F02P 3/0442* (2013.01); *F02P 5/14* (2013.01);
(Continued)

(58) Field of Classification Search
CPC .. F02P 3/02; F02P 3/045–0554; F02P 5/1502; F02P 9/002; F02P 15/10;
(Continued)

(56) References Cited

U.S. PATENT DOCUMENTS

2004/0129241 A1* 7/2004 Freen ..... F02C 7/266 60/39.821
2007/0267004 A1* 11/2007 Yamauchi ..... F02P 3/0892 123/604
(Continued)

FOREIGN PATENT DOCUMENTS

EP 2290223 A1 * 3/2011 ..... F02P 15/10
JP 2002-303238 A 10/2002
(Continued)

OTHER PUBLICATIONS

International Search Report (PCT/ISA/210) issued in PCT Application No. PCT/JP2019/039248 dated Dec. 10, 2019 with English translation (four (4) pages).
(Continued)

*Primary Examiner* — John M Zaleskas
(74) *Attorney, Agent, or Firm* — Crowell & Moring LLP

(57) ABSTRACT

To suppress a failure of ignition of a fuel caused by a spark plug while suppressing wear of an electrode of the spark plug in an internal combustion engine. A control device 1 for an internal combustion engine includes an ignition control unit that controls energization of an ignition coil 300 that applies electric energy to a spark plug 200 that discharges in a cylinder 150 of an internal combustion engine 100 to ignite a fuel. The ignition control unit continuously transmits a first pulse signal (pulse signal for corona discharge) to an igniter connected to the ignition coil 300 before dielectric breakdown between electrodes of the spark plug 200, and continuously transmits a second pulse signal (pulse signal for arc discharge) to the igniter after the dielectric breakdown between the electrodes of the spark plug 200 to control the energization of the ignition coil 300. At this time, a period of the pulse signal for corona discharge is shorter than a period of the pulse signal for arc discharge.

7 Claims, 15 Drawing Sheets

(51) Int. Cl.

| | |
|---|---|
| ***F02P 5/14*** | (2006.01) |
| ***F02P 15/10*** | (2006.01) |
| ***F02P 3/04*** | (2006.01) |
| ***F02P 9/00*** | (2006.01) |
| ***F02P 17/12*** | (2006.01) |

(52) U.S. Cl.
CPC ..... *F02P 9/007* (2013.01); *F02P 15/10* (2013.01); *F02P 17/12* (2013.01); *F02P 2017/121* (2013.01)

(58) Field of Classification Search
CPC .. F02P 17/12; F02P 23/00; F02P 23/04; F02P 9/007
See application file for complete search history.

(56) References Cited

U.S. PATENT DOCUMENTS

2009/0126668 A1* 5/2009 Shiraishi ..... H01T 13/50 123/145 A
2010/0307468 A1* 12/2010 Puettmann ..... F02P 15/10 123/636
2011/0114071 A1* 5/2011 Freen ..... F02P 23/04 123/623
2011/0144881 A1* 6/2011 Glugla ..... F02P 15/08 701/102
2011/0197865 A1* 8/2011 Hampton ..... F02P 23/045 315/120
2011/0270506 A1* 11/2011 Maier ..... F02P 3/051 701/102
2012/0145136 A1* 6/2012 Burrows ..... F02P 15/08 361/263
2012/0260898 A1* 10/2012 Schremmer ..... F02P 17/12 123/598
2012/0312285 A1* 12/2012 Bolz ..... F02P 3/0442 123/623
2013/0208393 A1* 8/2013 Hampton ..... F02P 3/01 361/247
2013/0263835 A1* 10/2013 Eisen ..... F02P 9/007 123/623
2013/0291833 A1* 11/2013 Eisen ..... F02P 3/053 123/406.12
2015/0008838 A1* 1/2015 Reuther ..... F02P 17/12 315/209 T
2016/0013623 A1* 1/2016 Zheng ..... H01T 13/50 361/263
2017/0096979 A1* 4/2017 Kinoshita ..... F02P 3/0435
2018/0038338 A1 2/2018 Sugiura et al.
2018/0119666 A1* 5/2018 Nakamura ..... F02P 5/1502
2019/0040835 A1* 2/2019 Tanaka ..... F02P 3/01
2019/0186454 A1* 6/2019 Asakura ..... F02P 5/15
2019/0293042 A1* 9/2019 Wakasugi ..... F02P 13/00
2020/0271084 A1* 8/2020 Inoue ..... H01T 13/50

FOREIGN PATENT DOCUMENTS

JP 2008121462 A * 5/2008
JP 2012-127286 A 7/2012
JP 2015181088 A * 10/2015
JP 2015-200257 A 11/2015
JP 2015200257 A * 11/2015
JP 2017045659 A * 3/2017 ..... F02P 15/10
JP 2018-21518 A 2/2018

OTHER PUBLICATIONS

Japanese-language Written Opinion (PCT/ISA/237) issued in PCT Application No. PCT/JP2019/039248 dated Dec. 10, 2019 (four (4) pages).

* cited by examiner

FIG. 6

| SETTING CONDITION | IGNITION TIME T3 | CORONA DISCHARGE PERIOD (T3−T2) | CHARGE PERIOD (T2−T1) | CORONA DISCHARGE VOLTAGE TARGET VALUE VC | ARC DISCHARGE CURRENT TARGET VALUE IA |
|---|---|---|---|---|---|
| ENGINE SPEED ⇒ BECOME HIGHER | BECOME EARLIER | BECOME LONGER | BECOME SHORTER | BECOME HIGHER | BECOME HIGHER |
| WEAR OF SPARK PLUG ELECTRODE ⇒ BECOME LARGER | BECOME EARLIER | BECOME LONGER | BECOME LONGER | BECOME HIGHER | BECOME HIGHER |
| GAP OF SPARK PLUG ELECTRODE ⇒ BECOME LARGER | BECOME EARLIER | BECOME LONGER | BECOME LONGER | BECOME HIGHER | BECOME HIGHER |
| TEMPERATURE OF SPARK PLUG ELECTRODE ⇒ BECOME LOWER | BECOME EARLIER | BECOME LONGER | BECOME LONGER | BECOME HIGHER | BECOME HIGHER |
| GAS PRESSURE IN COMBUSTION CHAMBER ⇒ BECOME HIGHER | BECOME EARLIER | BECOME LONGER | BECOME LONGER | BECOME HIGHER | BECOME HIGHER |
| GAS TEMPERATURE IN COMBUSTION CHAMBER ⇒ BECOME HIGHER | BECOME LATER | BECOME LONGER | BECOME LONGER | BECOME HIGHER | BECOME HIGHER |
| GAS HUMIDITY IN COMBUSTION CHAMBER ⇒ BECOME HIGHER | BECOME EARLIER | BECOME LONGER | BECOME LONGER | BECOME HIGHER | BECOME HIGHER |
| GAS FLOW VELOCITY IN COMBUSTION CHAMBER ⇒ BECOME HIGHER | BECOME LATER | BECOME LONGER | BECOME LONGER | BECOME HIGHER | BECOME HIGHER |
| AIR-FUEL RATIO ⇒ BECOME THINNER | BECOME EARLIER | BECOME LONGER | BECOME LONGER | BECOME HIGHER | BECOME HIGHER |
| EGR GAS AMOUNT ⇒ BECOME MORE | BECOME EARLIER | BECOME LONGER | BECOME LONGER | BECOME HIGHER | BECOME HIGHER |
| DIELECTRIC BREAKDOWN VOLTAGE OF PREVIOUS CYCLE ⇒ BECOME HIGHER | — | BECOME LONGER | BECOME LONGER | BECOME HIGHER | — |
| TEMPERATURE OF IGNITION COIL ⇒ BECOME HIGHER | BECOME EARLIER | BECOME SHORTER | BECOME SHORTER | — | — |

CONTROL DEVICE FOR INTERNAL COMBUSTION ENGINE

TECHNICAL FIELD

The present invention relates to a control device for an internal combustion engine.

BACKGROUND ART

In recent years, in order to improve fuel efficiency of a vehicle, a control device for an internal combustion engine has been developed which uses a technique of operating an internal combustion engine by combusting an air-fuel mixture which is thinner than a theoretical air-fuel ratio, a technique of taking in a portion of an exhaust gas after combustion to suck the portion again, or the like.

In this type of control device of an internal combustion engine, an amount of a fuel or air in a combustion chamber deviates from a theoretical value, and thus, a failure of ignition of the fuel by a spark plug is likely to occur. Therefore, there is a method of increasing an amount of heat generated in an electrode portion of the spark plug by increasing a discharge current of the spark plug to suppress the ignition failure. However, when the discharge current of the spark plug increases, wear of an electrode of the spark plug is promoted, and a life of the spark plug is shortened.

PTL 1 describes a control device of an internal combustion engine that reduces a discharge current of a spark plug by reducing a dielectric breakdown voltage between electrodes of the spark plug by performing corona discharge immediately before ignition when an energy charging system fails.

CITATION LIST

Patent Literature

PTL 1: JP 2002-303238 A

SUMMARY OF INVENTION

Technical Problem

In general, a discharge current for capacitance ignition that flows only for a short time at a start of discharge in a spark plug has a peak value larger than that of a discharge current for induced ignition that flows thereafter. Therefore, in order to suppress a failure of ignition of a fuel caused by the spark plug while suppressing wear of an electrode of the spark plug, it is necessary to reduce the discharge current for the capacitance ignition and appropriately control the discharge current for the induced ignition according to a state of an air-fuel mixture in a combustion chamber. However, with the technique disclosed in PTL 1, although it is possible to reduce the discharge current for the capacitance ignition, it is not possible to appropriately control the discharge current for the induced ignition.

Therefore, the present invention is made in consideration of the problems, and an object of the present invention is to suppress a failure of ignition of a fuel caused by a spark plug while suppressing wear of an electrode of the spark plug in an internal combustion engine.

Another object of the present invention is to estimate a flow velocity of an air-fuel mixture with high accuracy regardless of a state of an internal combustion engine and a state of the air-fuel mixture in a cylinder.

Solution to Problem

According to a first aspect of the present invention, there is provided a control device for an internal combustion engine including: an ignition control unit that controls energization of an ignition coil that applies electric energy to a spark plug that discharges in a cylinder of an internal combustion engine to ignite a fuel, in which the ignition control unit continuously transmits a first pulse signal to an igniter connected to the ignition coil before dielectric breakdown between electrodes of the spark plug, and continuously transmits a second pulse signal to the igniter after the dielectric breakdown between the electrodes of the spark plug to control the energization of the ignition coil, and a period of the first pulse signal is shorter than a period of the second pulse signal.

According to a second aspect of the present invention, there is provided a control device for an internal combustion engine including: a flow velocity estimation unit that estimates a flow velocity of an air-fuel mixture in a cylinder of an internal combustion engine, in which the flow velocity estimation unit estimates the flow velocity based on at least one of a discharge current and a discharge voltage of a spark plug that discharges in the cylinder to ignite a fuel.

Advantageous Effects of Invention

According to the present invention, it is possible to suppress a failure of ignition of a fuel caused by a spark plug while suppressing wear of an electrode of the spark plug in an internal combustion engine. Further, it is possible to estimate a flow velocity of an air-fuel mixture with high accuracy regardless of a state of an internal combustion engine and a state of the air-fuel mixture in a cylinder.

BRIEF DESCRIPTION OF DRAWINGS

FIG. 6 is a diagram illustrating an example of a method of setting each set value by an ignition control unit.

DESCRIPTION OF EMBODIMENTS

First Embodiment

Hereinafter, a control device for an internal combustion engine according to a first embodiment of the present invention will be described.

Hereinafter, a control device 1 which is one mode of the control device for an internal combustion engine according to the first embodiment will be described. In this embodiment, a case will be described as an example, in which the control device 1 controls the discharge (ignition) of a spark plug 200 provided in each cylinder 150 of a four-cylinder internal combustion engine 100.

Hereinafter, in the embodiment, a combination of some configurations or all configurations of the internal combustion engine 100 and some configurations or all configurations of the control device 1 is referred to as the control device 1 of the internal combustion engine 100.

[Internal Combustion Engine]

Figure 1:
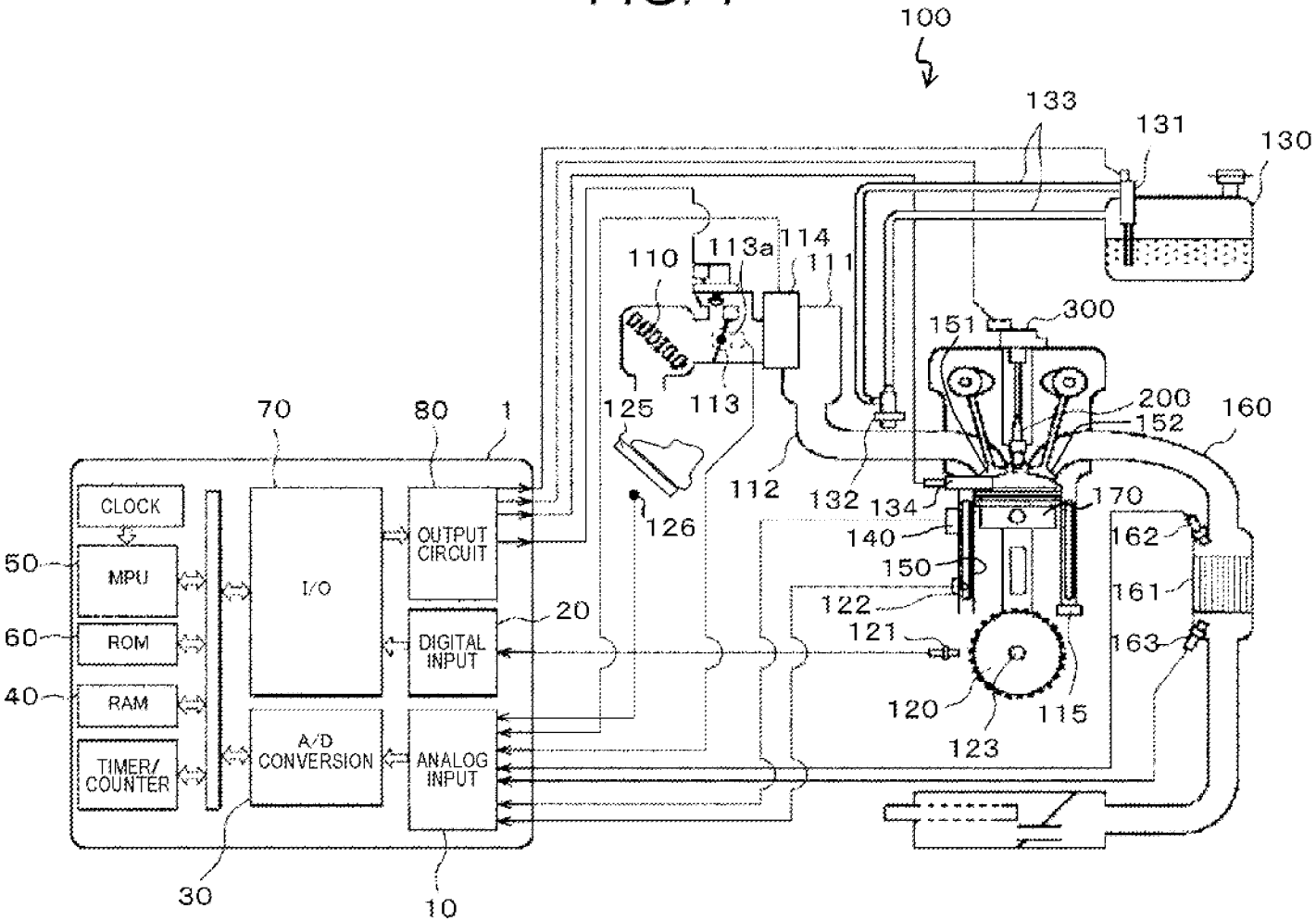
FIG. 1 is a diagram illustrating main configurations of an internal combustion engine and a control device for an internal combustion engine according to an embodiment.

FIG. 1 is a diagram illustrating main configurations of the internal combustion engine 100 and an ignition device for an internal combustion engine.

Figure 2:
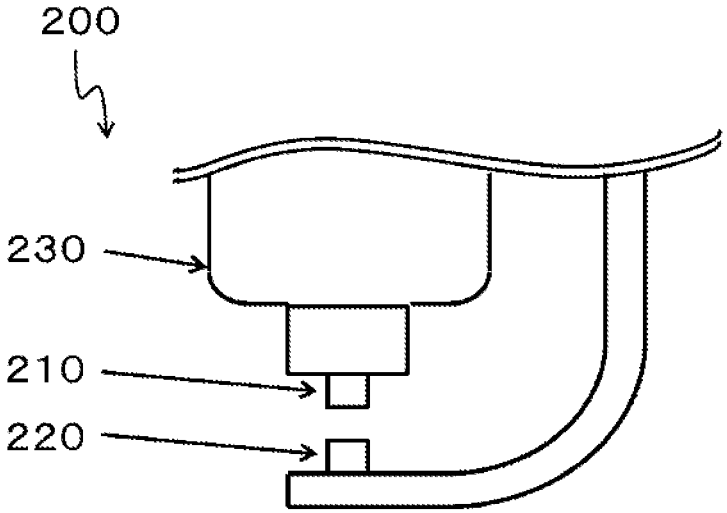
FIG. 2 is a partially enlarged view illustrating a spark plug.

FIG. 2 is a partially enlarged view illustrating electrodes 210 and 220 of the spark plug 200.

In the internal combustion engine 100, air sucked from the outside flows through an air cleaner 110, an intake pipe 111, and an intake manifold 112, and flows into each cylinder 150 when an intake valve 151 is opened. An amount of air flowing into each cylinder 150 is adjusted by a throttle valve 113, and the amount of air adjusted by the throttle valve 113 is measured by a flow rate sensor 114.

The throttle valve 113 is provided with a throttle opening sensor 113*a* which detects an opening of a throttle. Opening information of the throttle valve 113 detected by the throttle opening sensor 113*a* is output to the control device (Electronic Control Unit: ECU) 1.

As the throttle valve 113, an electronic throttle valve driven by an electric motor is used. However, any valve may be used as long as a flow rate of air can be appropriately adjusted.

A temperature of a gas flowing into each cylinder 150 is detected by an intake air temperature sensor 115.

A crank angle sensor 121 is provided radially outside a ring gear 120 attached to a crankshaft 123. The crank angle sensor 121 detects a rotation angle of the crankshaft 123. In the embodiment, for example, the crank angle sensor 121 detects the rotation angle of the crankshaft 123 every 10° and each combustion cycle.

A water temperature sensor 122 is provided in a water jacket (not illustrated) of a cylinder head. The water temperature sensor 122 detects a temperature of cooling water of the internal combustion engine 100.

Further, the vehicle includes an accelerator position sensor (APS) 126 that detects a displacement amount (depression amount) of an accelerator pedal 125. The accelerator position sensor 126 detects a torque required by a driver. The torque required by the driver detected by the accelerator position sensor 126 is output to the control device 1 described later. The control device 1 controls the throttle valve 113 based on this required torque.

A fuel stored in a fuel tank 130 is sucked and pressurized by a fuel pump 131, then flows through a fuel pipe 133 in which a pressure regulator 132 is provided, and is guided to a fuel injection valve (injector) 134. The fuel output from the fuel pump 131 is adjusted to a predetermined pressure by the pressure regulator 132, and is injected from the fuel injection valve (injector) 134 into each cylinder 150. As a result of the pressure adjustment by the pressure regulator 132, an excess fuel is returned to the fuel tank 130 via a return pipe (not illustrated).

The cylinder head (not illustrated) of the internal combustion engine 100 includes a combustion pressure sensor (CPS, also referred to as a cylinder pressure sensor) 140. The combustion pressure sensor 140 is provided in each cylinder 150 and detects a pressure (combustion pressure) in the cylinder 150.

As the combustion pressure sensor 140, a piezoelectric or gauge type pressure sensor may be used so as to detect the combustion pressure (cylinder pressure) in the cylinder 150 over a wide temperature range.

An exhaust valve 152 and an exhaust manifold 160 which discharges the gas (exhaust gas) after combustion to an outside of the cylinder 150 are attached to each cylinder 150. A three-way catalyst 161 is provided on an exhaust side of the exhaust manifold 160. When the exhaust valve 152 is opened, the exhaust gas is discharged from the cylinder 150 to the exhaust manifold 160. The exhaust gas passes through the exhaust manifold 160, is purified by the three-way catalyst 161, and is then discharged to the atmosphere.

An upstream-side air-fuel ratio sensor 162 is provided on an upstream side of the three-way catalyst 161. The upstream-side air-fuel ratio sensor 162 continuously detects an air-fuel ratio of the exhaust gas discharged from each cylinder 150.

Moreover, a downstream-side air-fuel ratio sensor 163 is provided on a downstream side of the three-way catalyst 161. The downstream-side air-fuel ratio sensor 163 outputs a switch-like detection signal in the vicinity of a theoretical air-fuel ratio. In the embodiment, for example, the downstream-side air-fuel ratio sensor 163 is an O2 sensor.

Further, the spark plug 200 is provided in an upper portion of each cylinder 150. Due to discharge (ignition) of the spark plug 200, a spark is ignited in an air-fuel mixture in the cylinder 150, an explosion occurs in the cylinder 150, and a piston 170 is pushed down. When the piston 170 is pushed down, the crankshaft 123 rotates.

An ignition coil 300 which generates electric energy (voltage) supplied to the spark plug 200 is connected to the spark plug 200. The discharge is generated between a center electrode 210 and an outer electrode 220 of the spark plug 200 (refer to FIG. 2) by the voltage generated in the ignition coil 300.

As illustrated in FIG. 2, in the spark plug 200, the center electrode 210 is supported by an insulator 230 in an insulated state. A predetermined voltage (in the embodiment, for example, 20,000 V to 40,000 V) is applied to this center electrode 210.

The outer electrode 220 is grounded. When a predetermined voltage is applied to the center electrode 210, the discharge (ignition) is generated between the center electrode 210 and the outer electrode 220.

In the spark plug 200, a dielectric breakdown of a gas component occurs due to a state of a gas existing between the center electrode 210 and the outer electrode 220 or the cylinder pressure, and the voltage at which the discharge (ignition) is generated is changed. The voltage at which this discharge is generated is referred to as a dielectric breakdown voltage.

A discharge control (ignition control) of the spark plug 200 is performed by an ignition control unit 83 of the control device 1 described later.

Returning to FIG. 1, an output signal from various sensors such as the throttle opening sensor 113*a*, the flow rate sensor 114, the crank angle sensor 121, the accelerator position sensor 126, the water temperature sensor 122, the combustion pressure sensor 140, or the like described above is output to the control device 1. The control device 1 detects an operation state of the internal combustion engine 100 based on the output signals from these various sensors, and controls an amount of air sent into the cylinder 150, a fuel injection amount, an ignition timing of the spark plug 200, or the like.

[Hardware Configuration of Control Device]

Next, the overall configuration of hardware of the control device 1 will be described.

As illustrated in FIG. 1, the control device 1 includes an analog input unit 10, a digital input unit 20, an Analog/Digital (A/D) conversion unit 30, a Random Access Memory (RAM) 40, and a Micro-Processing Unit (MPU) 50, a Read Only Memory (ROM) 60, an Input/Output (I/O) port 70, and an output circuit 80.

Analog output signals from various sensors such as the throttle opening sensor 113*a*, the flow rate sensor 114, the accelerator position sensor 126, the upstream-side air-fuel ratio sensor 162, the downstream-side air-fuel ratio sensor 163, the combustion pressure sensor 140, and the water temperature sensor 122 are input to the analog input unit 10.

The A/D conversion unit 30 is connected to the analog input unit 10. The analog output signals from the various sensors input to the analog input unit 10 are subjected to signal processing such as noise removal, then converted into digital signals by the A/D conversion unit 30, and stored in the RAM 40.

The digital output signal from the crank angle sensor 121 is input to the digital input unit 20.

The I/O port 70 is connected to the digital input unit 20, and the digital output signal input to the digital input unit 20 is stored in the RAM 40 via the I/O port 70.

Each output signal stored in the RAM 40 is arithmetically processed by the MPU 50.

The MPU 50 executes a control program (not illustrated) stored in the ROM 60 to arithmetically process the output signal stored in the RAM 40 according to the control program. The MPU 50 calculates a control value which defines an operation amount of each actuator (for example, the throttle valve 113, the pressure regulator 132, the spark plug 200, or the like) which drives the internal combustion engine 100 according to the control program, and temporarily stores the control value in the RAM 40.

The control value, which is stored in the RAM 40 and defines the operation amount of the actuator, is output to the output circuit 80 via the I/O port 70.

The output circuit 80 has a function of the ignition control unit 83 (refer to FIG. 3) which controls the voltage applied to the spark plug 200.

[Functional Block of Control Device]

Next, a functional configuration of the control device 1 according to the first embodiment will be described.

Figure 3:
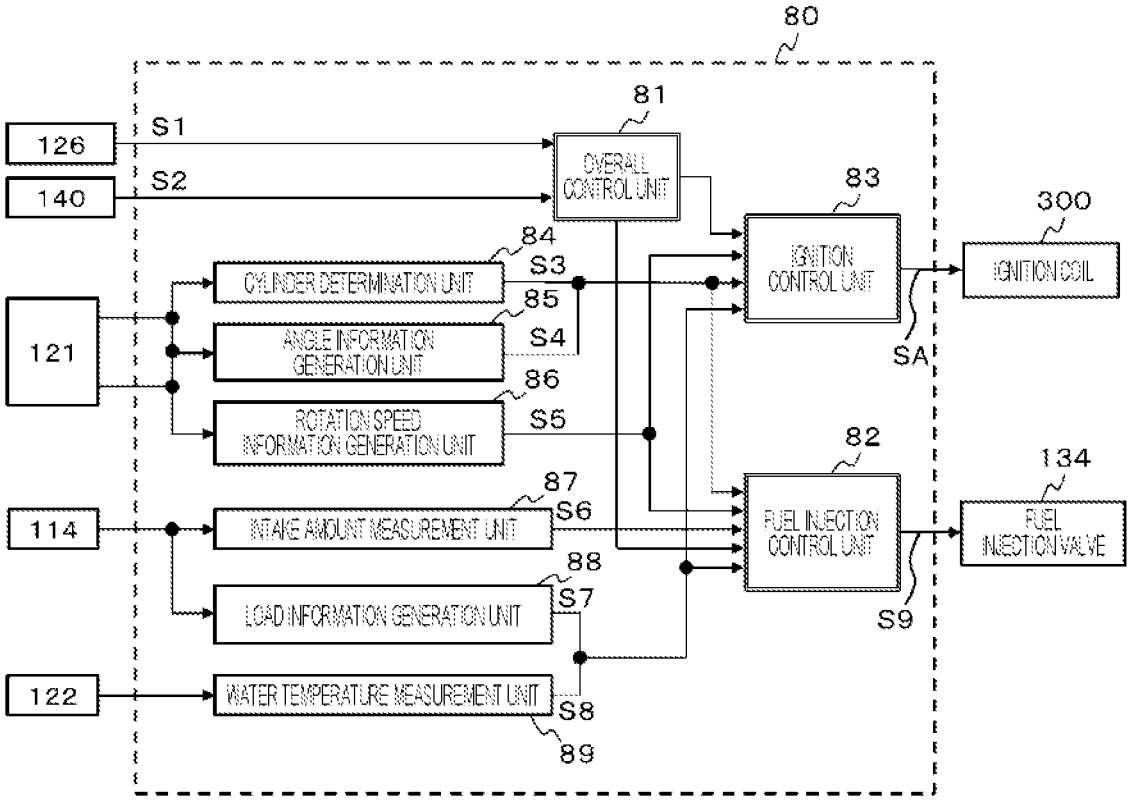
FIG. 3 is a functional block diagram illustrating a functional configuration of a control device according to a first embodiment.

FIG. 3 is a functional block diagram illustrating the functional configuration of the control device 1 according to the first embodiment. For example, each function of the control device 1 is realized by the output circuit 80 when the MPU 50 executes the control program stored in the ROM 60.

As illustrated in FIG. 3, the output circuit 80 of the control device 1 according to the first embodiment includes an overall control unit 81, a fuel injection control unit 82, and the ignition control unit 83.

The overall control unit 81 is connected to the accelerator position sensor 126 and the combustion pressure sensor 140 (CPS), and receives a required torque (acceleration signal S1) from the accelerator position sensor 126 and an output signal S2 from the combustion pressure sensor 140.

The overall control unit 81 controls the fuel injection control unit 82 and the ignition control unit 83 as a whole based on the required torque (acceleration signal S1) from the accelerator position sensor 126 and the output signal S2 from the combustion pressure sensor 140.

The fuel injection control unit 82 is connected to a cylinder determination unit 84 which determines each cylinder 150 of the internal combustion engine 100, an angle information generation unit 85 which measures a crank angle of the crankshaft 123, and a rotation speed information generation unit 86 which measures an engine speed, and receives cylinder determination information S3 from the cylinder determination unit 84, crank angle information S4 from the angle information generation unit 85, and engine speed information S5 from the rotation speed information generation unit 86.

Further, the fuel injection control unit 82 is connected to an intake amount measurement unit 87 which measures an intake amount of the air sucked into the cylinder 150, a load information generation unit 88 which measures an engine load, and a water temperature measurement unit 89 which measures a temperature of engine cooling water, and receives intake air amount information S6 from the intake amount measurement unit 87, engine load information S7 from the load information generation unit 88, and cooling water temperature information S8 from the water temperature measurement unit 89.

The fuel injection control unit 82 calculates an injection amount of fuel to be injected from the fuel injection valve 134 and an injection time (fuel injection valve control information S9) based on the received information, and controls the fuel injection valve 134 based on the calculated fuel injection amount and injection time.

The ignition control unit 83 is connected to the cylinder determination unit 84, the angle information generation unit 85, the rotation speed information generation unit 86, the load information generation unit 88, and the water temperature measurement unit 89 in addition to the overall control unit 81, and receives each information from these.

The ignition control unit 83 calculates an amount of current (energization angle) for energizing a primary coil (not illustrated) of the ignition coil 300, an energization start time, and a time (ignition time) when the current for energizing the primary coil is cut off, based on the received information.

The ignition control unit 83 outputs an ignition signal SA to a primary coil 310 of the ignition coil 300 based on the calculated energization angle, energization start time, and ignition time to perform a discharge control (ignition control) by the spark plug 200.

At least a function of the ignition control unit 83 to control the ignition of the spark plug 200 using the ignition signal SA corresponds to the control device for an internal combustion engine of the present invention.

[Electric Circuit of Ignition Coil]

Next, an electric circuit 400 including the ignition coil 300 according to the first embodiment will be described.

Figure 4:
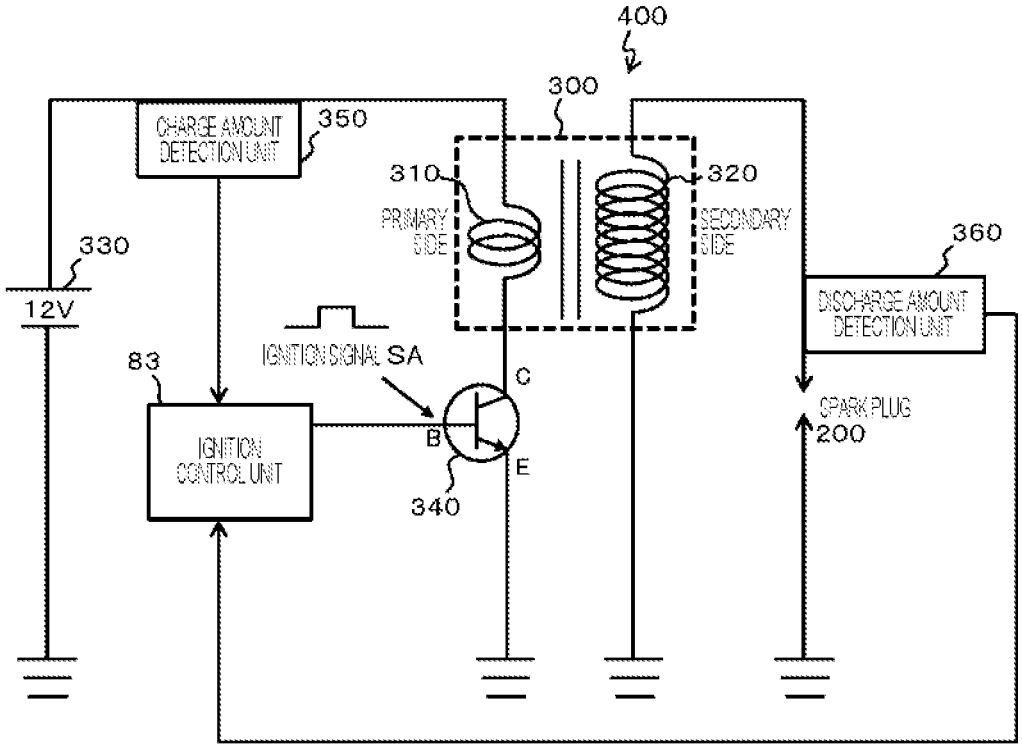
FIG. 4 is a diagram illustrating an electric circuit including an ignition coil according to the first embodiment.

FIG. 4 is a diagram illustrating the electric circuit 400 including the ignition coil 300 according to the first embodiment. In the electric circuit 400, the ignition coil 300 is configured to include the primary coil 310 wound with a predetermined number of turns and a secondary coil 320 wound with the number of turns larger than that of the primary coil 310.

One end of the primary coil 310 is connected to a DC power supply 330. As a result, a predetermined voltage (for example, in the embodiment, 12 V) is applied to the primary coil 310. A charge amount detection unit 350 is provided in a connection path between the DC power supply 330 and the primary coil 310. The charge amount detection unit 350 detects the voltage and current applied to the primary coil 310 and transmits the detected voltage and current to the ignition control unit 83.

The other end of the primary coil 310 is connected to an igniter 340 and is grounded via the igniter 340. A transistor, a field effect transistor (FET), or the like is used for the igniter 340.

A base (B) terminal of the igniter 340 is connected to the ignition control unit 83. The ignition signal SA output from the ignition control unit 83 is input to the base (B) terminal of the igniter 340. When the ignition signal SA is input to the base (B) terminal of the igniter 340, a collector (C) terminal and an emitter (E) terminal of the igniter 340 are energized, and a current flows between the collector (C) terminal and the emitter (E) terminal. Accordingly, the ignition signal SA is output from the ignition control unit 83 to the primary coil 310 of the ignition coil 300 via the igniter 340, and electric power (electric energy) is accumulated in the primary coil 310.

When the output of the ignition signal SA from the ignition control unit 83 is stopped and the current flowing through the primary coil 310 is cut off, a high voltage corresponding to a ratio of the number of turns of the coil with respect to the primary coil 310 is generated in the secondary coil 320. By applying the high voltage generated in the secondary coil 320 to the spark plug 200 (center electrode 210), a potential difference is generated between the center electrode 210 and the outer electrode 220 of the spark plug 200. When the potential difference generated between the center electrode 210 and the outer electrode 220 is equal to or more than a dielectric breakdown voltage Vm of the gas (air-fuel mixture in the cylinder 150), a gas component is dielectrically broken, discharge is generated between the center electrode 210 and the outer electrode 220, and the fuel (air-fuel mixture) is ignited.

A discharge amount detection unit 360 is provided in a connection path between the secondary coil 320 and the spark plug 200. The discharge amount detection unit 360 detects the discharge voltage and current and transmits the detected discharge voltage and current to the ignition control unit 83.

The ignition control unit 83 controls the energization of the ignition coil 300 using the ignition signal SA by the operation of the electric circuit 400 as described above. As a result, the ignition control for controlling the spark plug 200 is performed.

[Output Timing of Ignition Signal]

Next, an output timing of the ignition signal SA will be described with respect to the method of heating the electrode of the spark plug 200 according to the first embodiment.

Figure 5:
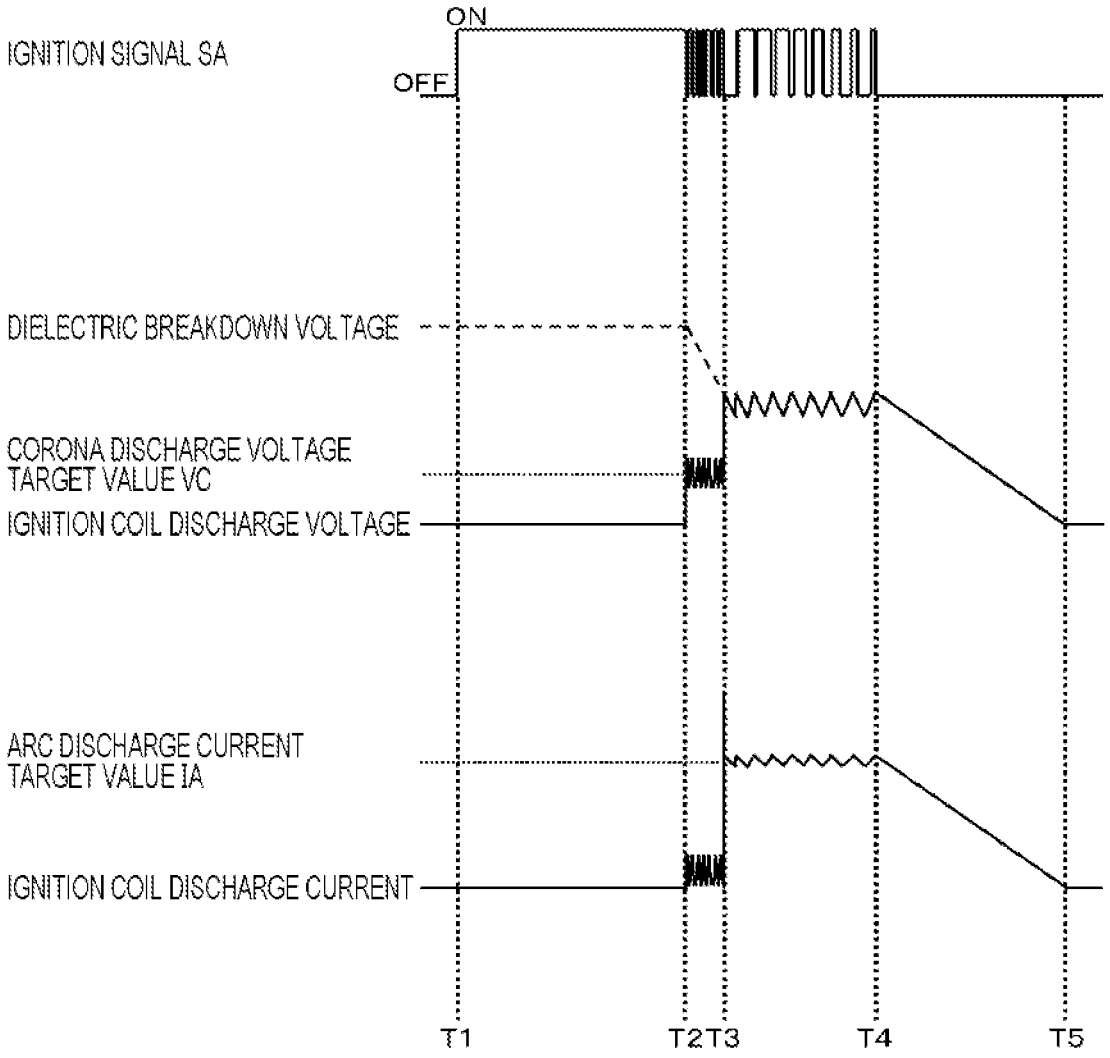
FIG. 5 is an example of a timing chart illustrating an output timing of an ignition signal according to the first embodiment.

FIG. 5 is an example of a timing chart illustrating the output timing of the ignition signal SA according to the first embodiment.

In FIG. 5, an upper figure illustrates ON/OFF of the ignition signal SA output from the ignition control unit 83 to the ignition coil 300. A middle figure illustrates a discharge voltage of the ignition coil 300, that is, a voltage applied between the center electrode 210 and the outer electrode 220 of the spark plug 200 from the secondary coil 320 of the ignition coil 300. This discharge voltage is detected by the discharge amount detection unit 360 and input to the ignition control unit 83 as described above. A lower figure illustrates a discharge current of the ignition coil 300, that is, a current flowing through the secondary coil 320 of the ignition coil 300 and the spark plug 200 according to the discharge voltage. Similar to the discharge voltage, the discharge current is also detected by the discharge amount detection unit 360 and input to the ignition control unit 83. A magnitude of the discharge voltage of the ignition coil 300 is equal to a value obtained by multiplying a magnitude of the discharge current by a resistance value between the center electrode 210 and the outer electrode 220 of the spark plug 200.

In FIG. 5, a time T1 indicates a charge start time. At this time T1, when the ignition control unit 83 changes the ignition signal SA from OFF to ON, the DC power supply 330 starts energizing the primary coil 310, a primary current flows to the primary coil 310, and thus, electric power is charged in the ignition coil 300.

A time T2 indicates a start time of the corona discharge. At this time T2, the ignition control unit 83 performs pulse width modulation on the ignition signal SA, and continuously outputs the ignition signal SA based on a pulse signal to the igniter 340. As a result, in the ignition signal SA, switching from ON to OFF and switching from OFF to ON are alternately repeated.

When the ignition signal SA is switched from ON to OFF, the primary current is cut off in the primary coil 310, the electric power charged up to that point is released from the ignition coil 300, and electric energy is supplied to the spark plug 200. As a result, a voltage corresponding to the supplied electric energy is applied between the center electrode 210 and the outer electrode 220 of the spark plug 200. Meanwhile, when the ignition signal SA is switched from OFF to ON, the primary current is re-energized in the primary coil 310, and charging of the ignition coil 300 is restarted.

The ignition control unit 83 performs the pulse width modulation on the ignition signal SA as described above during a corona discharge period from the time T2 to the time T3. At this time, the ignition control unit 83 controls the pulse width of the ignition signal SA so that the discharge voltage of the ignition coil 300 approaches a predetermined corona discharge voltage target value VC (refer to the middle stage of FIG. 5). The corona discharge in the present embodiment is a phenomenon in which the air-fuel mixture is ionized when a small amount of discharge current flows between the center electrode 210 and the outer electrode 220 of the spark plug 200 due to partial dielectric breakdown. The corona discharge voltage target value VC is a target value of the discharge voltage for generating this corona discharge, and is preset in the ignition control unit 83 with a value smaller than the dielectric breakdown voltage.

The ignition control unit 83 performs the above control during the corona discharge period to generate a corona discharge between the center electrode 210 and the outer electrode 220 of the spark plug 200, and thus, as illustrated by the broken line in the middle figure of FIG. 5, the dielectric breakdown voltage between the center electrode 210 and the outer electrode 220 of the spark plug 200 gradually decreases. As a result, a discharge current for capacitance ignition that first flows through the spark plug 200 at the time of ignition can be reduced, and thus, a maximum value of the discharge current can be reduced. Therefore, it is possible to suppress wear of the center electrode 210 and the outer electrode 220 that occur in the spark plug 200 due to repeated ignition.

The time T3 indicates an ignition time at which the corona discharge period ends. At this time T3, the ignition control unit 83 ends the pulse width modulation for the corona discharge and switches the ignition signal SA from ON to OFF. Then, the primary current is cut off in the primary coil 310, the electric power charged up to that point is released from the ignition coil 300, and electric energy is supplied to the spark plug 200. Accordingly, a voltage corresponding to the supplied electric energy is applied between the center electrode 210 and the outer electrode 220 of the spark plug 200. Then, as illustrated in the middle figure of FIG. 5, when the discharge voltage of the ignition coil 300 matches the dielectric breakdown voltage, the dielectric breakdown occurs between the center electrode 210 and the outer electrode 220 of the spark plug 200, and arc discharge starts.

When the arc discharge starts, the ignition control unit 83 performs the pulse width modulation on the ignition signal SA, and continuously outputs the ignition signal SA with a pulse signal different from the pulse signal during the corona discharge to the igniter 340. At this time, the ignition control unit 83 controls the pulse width of the ignition signal SA so that the discharge current of the ignition coil 300 approaches a predetermined arc discharge current target value IA (refer to the middle stage of FIG. 5). The arc discharge in the present embodiment is a phenomenon in which the dielectric breakdown is performed between the center electrode 210 and the outer electrode 220 of the spark plug 200, a discharge current larger than the discharge current at the time of corona discharge flows, and the fuel in the air-fuel mixture is ignited by the spark generated at this time. The arc discharge current target value IA is a target value of the discharge current for stably continuing this arc discharge and satisfactorily igniting the fuel, and is preset in the ignition control unit 83.

A time T4 indicates an end time of the pulse width modulation during the arc discharge period. When the discharge current of the ignition coil 300 becomes less than the arc discharge current target value IA at the time T4 and the discharge current cannot be maintained at the arc discharge current target value IA any more, the ignition control unit 83 ends the pulse width modulation, and the ignition signal SA is turned OFF. As a result, charging of the ignition coil 300 ends, and the discharge voltage and the discharge current gradually decrease as illustrated in each of the middle and lower figures of FIG. 5. After that, when the discharge voltage and the discharge current decreases to almost zero at the time T5, the arc discharge ends. That is, a period from the time T3 to the time T5 is the arc discharge period, and the pulse width modulation is performed in the period from the time T3 to the time T4.

As illustrated in the upper figure of FIG. 5, the period of the pulse signal output as the ignition signal SA during the corona discharge period is shorter than the period of the pulse signal output as the ignition signal SA during the arc discharge period. This is because the pulse width modulation is performed based on the discharge voltage during the corona discharge period, whereas the pulse width modulation is performed based on the discharge current during the arc discharge period. As a result, during the corona discharge period before ignition, the corona discharge is surely continued to reduce the dielectric breakdown voltage, and the maximum value of the discharge current flowing during the subsequent ignition is reduced, and during the arc discharge period after the ignition, the discharge current can be appropriately controlled. Therefore, it is possible to suppress the failure of ignition of the fuel while suppressing the wear of the center electrode 210 or the outer electrode 220 of the spark plug 200.

Here, in the period from the time T1 to the time T4, the ignition coil 300 is charged. In this period, a period from the time T1 to the time T2 before the start of pulse width modulation is a charge period in which the ignition coil 300 is continuously charged. Moreover, the period from the time T2 to the time T3 is the corona discharge period, and during this period, the ignition control unit 83 performs the pulse width modulation on the ignition signal SA, and thus, the discharge voltage of the ignition coil 300 is adjusted to reach the corona discharge voltage target value VC. Further, the period from the time T3 to the time T5 is the arc discharge period, and in the period from the time T3 to the time T4 of the arc discharge period, the ignition control unit 83 performs the pulse width modulation on the ignition signal SA, and thus, the discharge current of the ignition coil 300 is adjusted to reach the arc discharge current target value IA. For example, these periods can be determined based on the operation state of the internal combustion engine 100, the states of the center electrode 210 and the outer electrode 220 of the spark plug 200, the state of the air-fuel mixture in the cylinder 150 of the internal combustion engine 100, or the like. The corona discharge voltage target value VC and the arc discharge current target value IA can be also determined based on the operation state of the internal combustion engine 100, the states of the center electrode 210 and the outer electrode 220 of the spark plug 200, the state of the air-fuel mixture in the cylinder 150 (combustion chamber) of the internal combustion engine 100, or the like.

FIG. 6 is a diagram illustrating an example of a method of setting each set value by the ignition control unit 83. FIG. illustrates an example of relationships between various setting conditions including the operation state of the internal combustion engine 100, the electrode state of the spark plug 200, the state (gas state in the combustion chamber) of the air-fuel mixture in the cylinder 150, or the like, and each set value of the ignition time T3, the corona discharge period (T3–T2), the charge period (T2–T1), the corona discharge voltage target value VC, and the arc discharge current target value IA.

The ignition control unit 83 can set each set value as follows based on the relationship illustrated in FIG. 6. For example, in the internal combustion engine 100, when the air-fuel ratio of the air-fuel mixture taken into the cylinder 150 becomes thinner, a combustion speed in the cylinder 150 decreases. Therefore, according to FIG. 6, the ignition time T3 becomes earlier so that the center of gravity of combustion is aligned. In addition, since the ignitability of the fuel is reduced, according to FIG. 6, the corona discharge period and the charge period are lengthened, and the corona discharge voltage target value VC and the arc discharge current target value IA increase. As a result, the amount of corona increases, discharge energy of the ignition coil 300 increases, and the ignitability of the fuel is improved. Even in other cases, it is possible to set each set value in the same manner based on the relationship illustrated in FIG. 6.

Further, the corona discharge voltage target value VC can be set based on the dielectric breakdown voltage detected by the discharge amount detection unit 360 when the spark plug 200 performs the arc discharge in the previous or earlier cycle. Specifically, for example, when a dielectric breakdown voltage higher than a predetermined value is detected in the previous cycle, the corona discharge voltage target value VC is set high in this cycle to decrease the dielectric breakdown voltage according to FIG. 6. On the contrary, for example, when the dielectric breakdown voltage lower than the predetermined value is detected in the previous cycle, the dielectric breakdown voltage is raised by decreasing the corona discharge voltage target value VC in this cycle, and it may be possible to prevent the dielectric breakdown from occurring during the corona discharge period before the ignition time T3 and erroneous ignition from being generated.

[Control Method of Ignition Coil]

Figure 7:
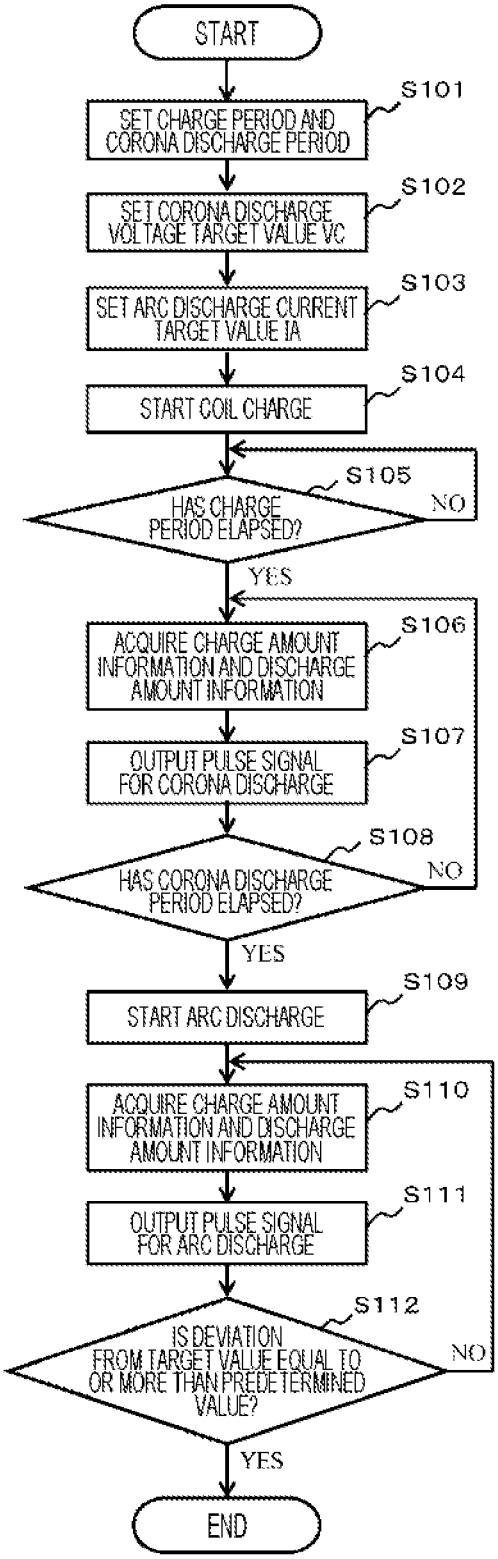
FIG. 7 is an example of a flowchart illustrating a method for controlling a spark plug by an ignition control unit according to the first embodiment.

Next, an example of a control method of the ignition coil 300 by the ignition control unit 83 will be described. FIG. 7 is an example of a flowchart illustrating a method for controlling the ignition coil 300 by the ignition control unit 83 according to the first embodiment. In the first embodiment, when an ignition switch of a vehicle is turned on and the power of the internal combustion engine 100 is turned on, the ignition control unit 83 starts controlling the ignition coil 300 according to the flowchart of FIG. 7. Processing illustrated in the flowchart of FIG. 7 represents processing for one cycle of the internal combustion engine 100, and the ignition control unit 83 executes the processing illustrated in the flowchart of FIG. 7 for each cycle.

In Step S101, the ignition control unit 83 sets the charge period and the corona discharge period. Here, for example, by referring to a DWELL map illustrating the values of the charge period preset for each operation state of the internal combustion engine 100, and the relationship between the setting conditions and each set value illustrated in FIG. 6, the charge period and the corona discharge period are set.

In Step S102, the ignition control unit 83 sets the corona discharge voltage target value VC. Here, for example, based on the relationship between the setting conditions and the corona discharge voltage target value VC illustrated in FIG. 6, or the dielectric breakdown voltage detected in the previous cycle or the past cycle, the corona discharge voltage target value VC in this cycle is set.

In Step S103, the ignition control unit 83 sets the arc discharge current target value IA. Here, for example, using the relationship between the setting conditions and the arc discharge current target value IA illustrated in FIG. 6, the arc discharge current target value IA in this cycle is set based on at least one of the operation state of the internal combustion engine 100, the electrode state of the spark plug 200, and the state of the air-fuel mixture in the cylinder 150.

In Step S104, the ignition control unit 83 starts charging the ignition coil 300.

Here, according to the charge period set in Step S101, the ignition signal SA is switched from OFF to ON at the charge start time T1 to start charging the ignition coil 300.

In Step S105, the ignition control unit 83 determines whether or not the charge period set in Step S101 has elapsed after the charging of the ignition coil 300 started in Step S104. If the charge period has not yet elapsed, the process stays in Step S105 to continue charging the ignition coil 300, and when the charge period has elapsed, the process proceeds to Step S106.

In Step S106, the ignition control unit 83 acquires information on the charge amount of the ignition coil 300 detected by the charge amount detection unit 350, that is, information on the voltage and current applied to the primary coil 310 in the ignition coil 300, and information on the discharge amount of the ignition coil 300 detected by the discharge amount detection unit 360, that is, information on the voltage and current generated in the secondary coil 320 in the ignition coil 300.

In Step S107, the ignition control unit 83 starts outputting a pulse signal for corona discharge at the corona discharge start time T2. Here, the pulse width modulation is performed on the ignition signal SA so that the discharge voltage approaches the corona discharge voltage target value VC set in Step S102 based on the information on the charge amount and discharge amount acquired in Step S106, and thus, the pulse width of the pulse signal output as the ignition signal SA is adjusted. For the control at this time, for example, feedback control is used.

In Step S108, the ignition control unit 83 determines whether or not the corona discharge period set in Step S101 has elapsed after the output of the pulse signal for corona discharge started in Step S107. If the corona discharge period has not yet elapsed, the process returns to Step S106, the discharge voltage is acquired, and the output of the pulse signal for the corona discharge is continued. After the corona discharge period has elapsed, the process proceeds to Step S109.

In Step S109, the ignition control unit 83 switches the ignition signal SA from ON to OFF at the ignition time T3, and supplies the electric energy stored in the ignition coil 300 to the spark plug 200 to start the arc discharge of the spark plug 200.

In Step S110, similarly to Step S106, the ignition control unit 83 acquires has the information on the charge amount of the ignition coil 300 detected by the charge amount detection unit 350 and the information on the discharge amount of the ignition coil 300 detected by the discharge amount detection unit 360. The discharge voltage included in the information on the discharge amount acquired here is used as the dielectric breakdown voltage detected in the previous cycle or the past cycle when the corona discharge voltage target value VC is set in Step S102 in the next cycle or later.

In Step S111, the ignition control unit 83 starts outputting a pulse signal for the arc discharge. Here, based on the information on the discharge amount acquired in Step S110, the pulse width modulation is performed on the ignition signal SA so that the discharge current approaches the arc discharge current target value IA set in Step S103, and thus, the pulse width of the pulse signal output as the ignition signal SA is adjusted. For the control at this time, for example, feedback control is used.

In Step S112, the ignition control unit 83 determines whether or not the discharge current is less than the arc discharge current target value IA and a deviation between the discharge current and the arc discharge current target value IA is equal to or more than a predetermined value. If the deviation is less than the predetermined value, the process returns to Step S110, the discharge current is acquired, and the output of the pulse signal for the arc discharge is continued. When the deviation is equal to or more than the predetermined value, it is determined that the discharge current cannot be maintained at the arc discharge current target value IA any more, the output of the pulse signal is stopped, and the control of the ignition coil 300 according to the flowchart of FIG. 7 ends. After that, the energy in the ignition coil 300 gradually decreases, and the discharge of the spark plug 200 stops at the discharge end time T5.

Next, another output method of the ignition signal SA according to the first embodiment will be described.

[Output Method of Ignition Signal During Continuous Ignition]

Figure 8:
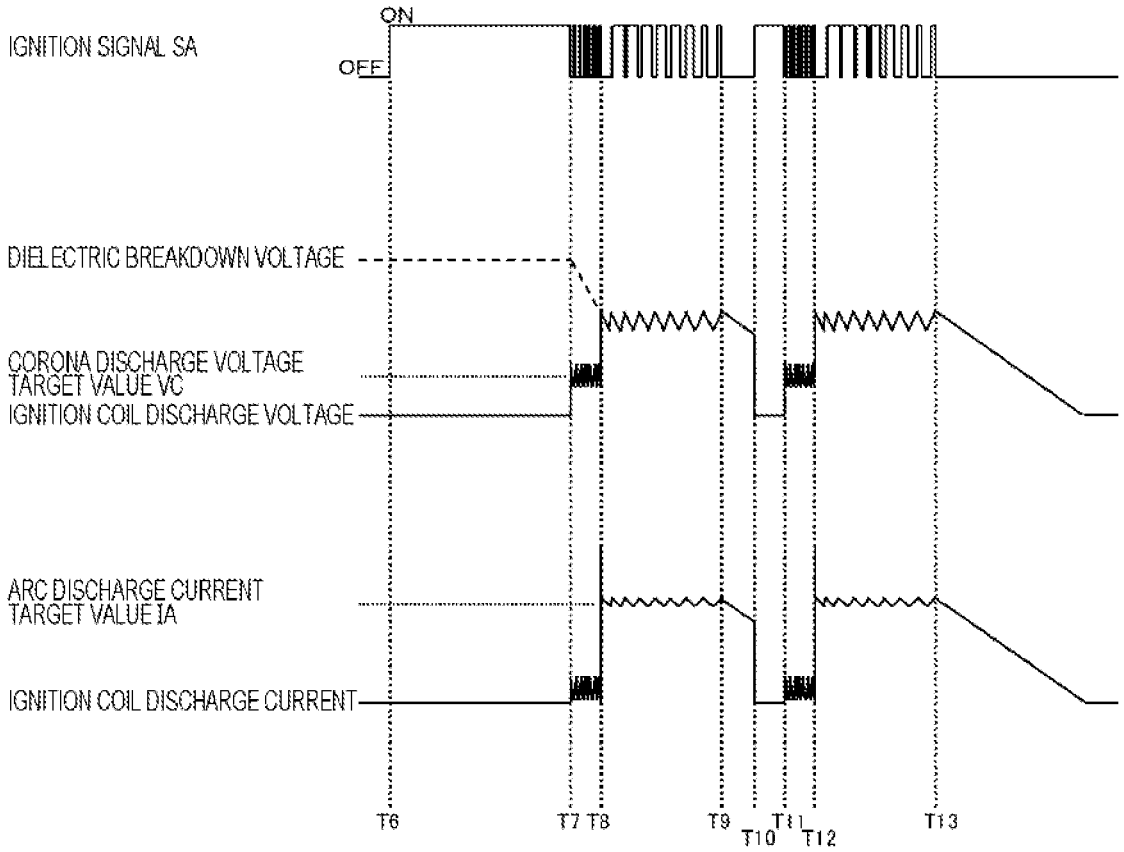
FIG. 8 is an example of a timing chart illustrating an output method of an ignition signal when continuous ignition is performed.

FIG. 8 is an example of a timing chart illustrating an output method of the ignition signal SA in the case of continuous ignition.

In FIG. 8, upper, middle and lower figures are the same as those of the timing chart illustrated in FIG. 5, respectively. That is, the upper figure illustrates ON/OFF of the ignition signal SA output from the ignition control unit 83 to the ignition coil 300. A middle figure illustrates a discharge voltage of the ignition coil 300, that is, a voltage applied between the center electrode 210 and the outer electrode 220 of the spark plug 200 from the secondary coil 320 of the ignition coil 300. A lower figure illustrates a discharge current of the ignition coil 300, that is, a current flowing through the secondary coil 320 of the ignition coil 300 and the spark plug 200 according to the discharge voltage.

In FIG. 8, a time T6 indicates a first charge start time. At this time T6, when the ignition control unit 83 changes the ignition signal SA from OFF to ON, the DC power supply 330 starts energizing the primary coil 310, and the primary current flows to the primary coil 310, and thus, electric power is charged in the ignition coil 300.

A period from a time T7 to a time T8 indicates a first corona discharge period. During this period, similarly to the corona discharge period (T3–T2) in FIG. 5, the ignition control unit 83 performs the pulse width modulation on the ignition signal SA so that the discharge voltage of the ignition coil 300 approaches the corona discharge voltage target value VC and outputs the modulated ignition signal SA.

The time T8 indicates an ignition time at which the first corona discharge period ends. At this time T8, the ignition control unit 83 ends the pulse width modulation for the corona discharge and switches the ignition signal SA from ON to OFF. Then, the primary current is cut off in the primary coil 310, the electric power charged up to that point is released from the ignition coil 300, and electric energy is supplied to the spark plug 200. Accordingly, similarly to the ignition time T3 in FIG. 5, the dielectric breakdown occurs between the center electrode 210 and the outer electrode 220 of the spark plug 200, and first arc discharge starts.

When the first arc discharge starts, similarly to the pulse signal output period (T4–T3) during the arc discharge in FIG. 5, the ignition control unit 83 performs the pulse width modulation on the ignition signal SA so that the discharge current of the ignition coil 300 approaches the arc discharge current target value IA and outputs the modulated ignition signal SA. After that, when the discharge current becomes less than the arc discharge current target value IA at the time T9 and the discharge current cannot be maintained at the arc discharge current target value IA any more, the ignition control unit 83 temporarily ends the pulse width modulation. As a result, charging of the ignition coil 300 ends, and the discharge voltage and the discharge current gradually decrease.

A time T10 indicates a second charge start time. At this time T10, when the ignition control unit 83 changes the ignition signal SA from OFF to ON, the energization from the DC power supply 330 to the primary coil 310 restarts, the primary current flows through the primary coil 310, and thus, electric power is charged in the ignition coil 300.

After a time T11 when the second charge ends, the ignition control unit 83 performs the same controls as those of the times T7 to T9. That is, a period from the time T11 to a time T12 is a second corona discharge period, and in this period, the ignition control unit 83 performs the pulse width modulation on the ignition signal SA so that the discharge voltage of the ignition coil 300 approaches the corona discharge voltage target value VC and outputs the modulated ignition signal SA. At the time T12, the ignition control unit 83 ends the pulse width modulation for the corona discharge, switches the ignition signal SA from ON to OFF, and starts second arc discharge. Then, the ignition control unit 83 performs the pulse width modulation on the ignition signal SA so that the discharge current of the ignition coil 300 approaches the arc discharge current target value IA and outputs the modulated ignition signal SA. When the discharge current becomes less than the arc discharge current target value IA at a time T13 and the discharge current cannot be maintained at the arc discharge current target value IA any more, the ignition control unit 83 ends the pulse width modulation. As a result, the discharge voltage and the discharge current gradually decrease, and the arc discharge ends.

The ignition control unit 83 can obtain the same effect as those described with reference to FIG. 5 even when the continuous ignition is performed by the control as described above. That is, during the corona discharge period before ignition, the corona discharge is surely continued to decrease the dielectric breakdown voltage, and the maximum value of the discharge current flowing during the subsequent ignition decreases, and during the arc discharge period after ignition, the discharge current can be appropriately controlled. Therefore, it is possible to suppress the failure of ignition of the fuel while suppressing the wear of the center electrode 210 or the outer electrode 220 of the spark plug 200.

[Output Method of Ignition Signal when Discharge is Short-Circuited]

Figure 9:
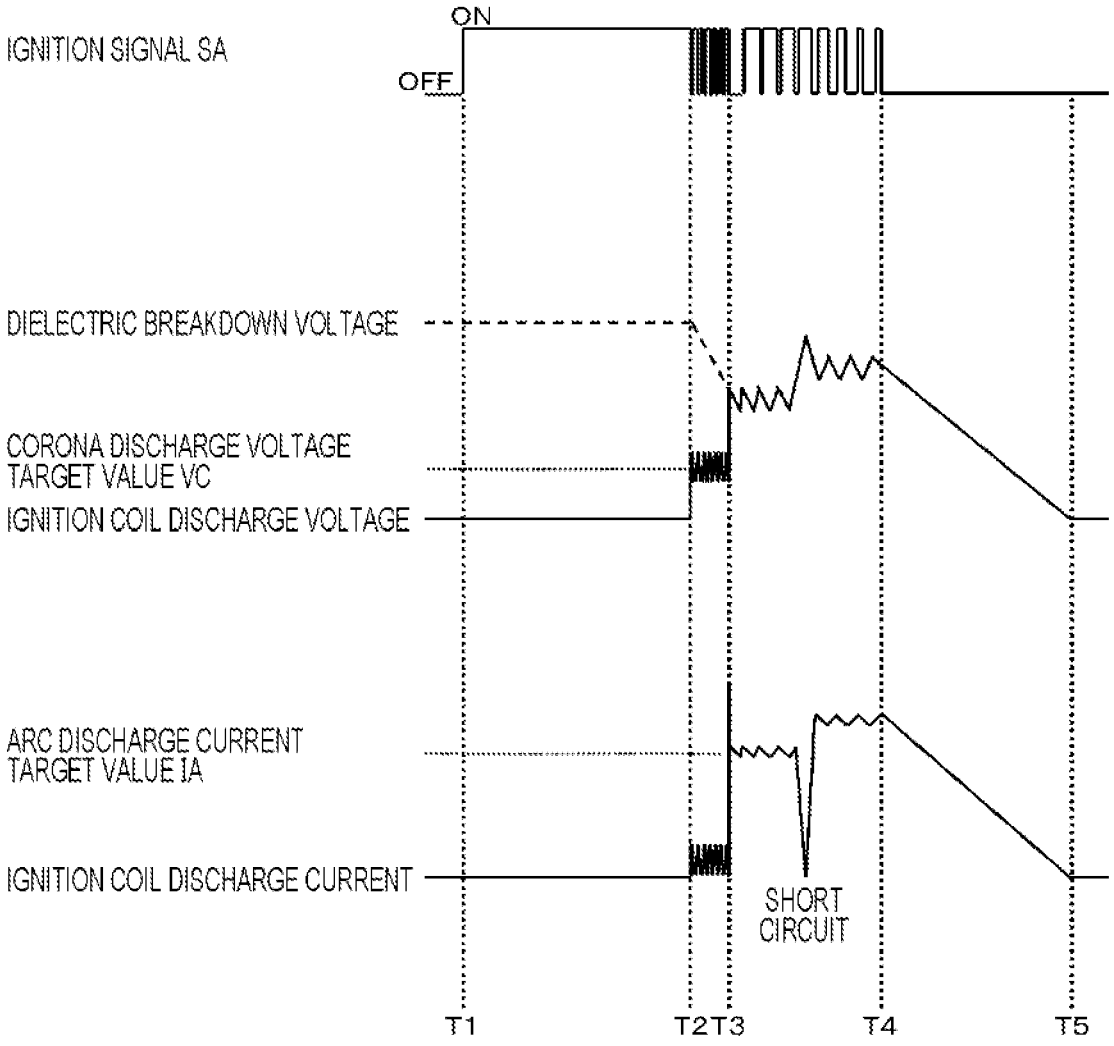
FIG. 9 is an example of a timing chart illustrating an output method of an ignition signal when an interruption of arc discharge occurs after dielectric breakdown.

FIG. 9 is an example of a timing chart illustrating an output method of the ignition signal SA when an interruption (short circuit) of the arc discharge occurs after the dielectric breakdown.

In FIG. 9, upper, middle and lower figures are the same as those of the timing chart illustrated in FIG. 5, respectively. That is, the upper figure illustrates ON/OFF of the ignition signal SA output from the ignition control unit 83 to the ignition coil 300. A middle figure illustrates a discharge voltage of the ignition coil 300, that is, a voltage applied between the center electrode 210 and the outer electrode 220 of the spark plug 200 from the secondary coil 320 of the ignition coil 300. A lower figure illustrates a discharge current of the ignition coil 300, that is, a current flowing through the secondary coil 320 of the ignition coil 300 and the spark plug 200 according to the discharge voltage. Further, times T1 to T5 are the same as those of the timing chart illustrated in FIG. 5. That is, the time T1 indicates the charge start time, the time T2 indicates the start time of the corona discharge, the time T3 indicates the ignition time, the time T4 indicates the end time of pulse width modulation during the arc discharge period, and the time T5 indicates the end time of the arc discharge, respectively.

Here, in the period from the time T3 to the time T4, when the ignition control unit 83 performs a charge/discharge control of the ignition coil 300 by the pulse width modulation so that the discharge current of the ignition coil 300 approaches the predetermined arc discharge current target value IA, the interruption (short circuit) of the arc discharge occurs. In this case, the ignition control unit 83 is modified so as to increase the arc discharge current target value IA as illustrated in the lower figure. As a result, the arc discharge is restarted, and the subsequent arc discharge can be continued stably. In the next and subsequent cycles, the modified arc discharge current target value IA may be used.

[Output Method of Ignition Signal According to Passage of Time after Dielectric Breakdown]

Figure 10:
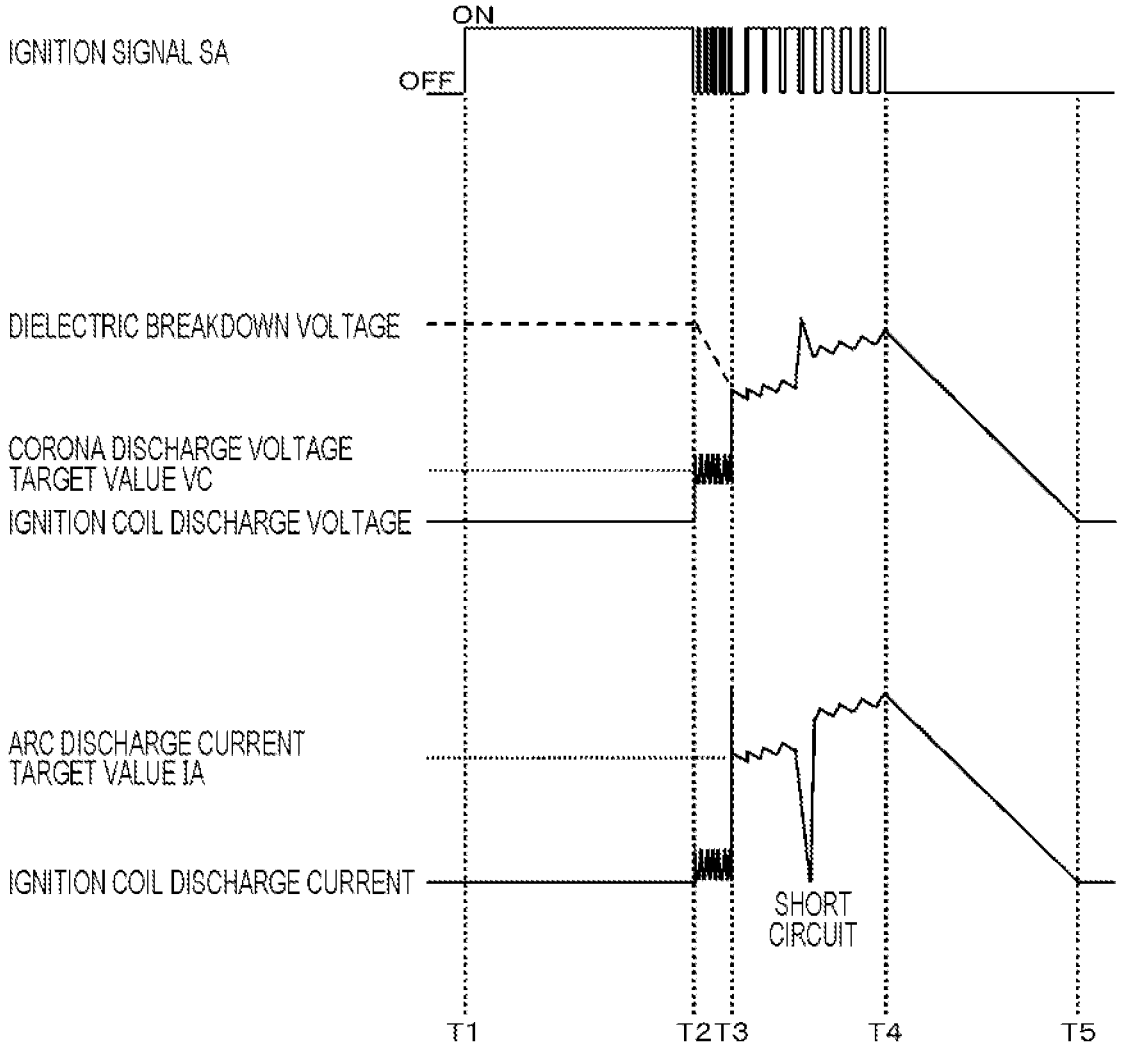
FIG. 10 is an example of a timing chart illustrating the output method of an ignition signal according to an elapsed time after the dielectric breakdown.

FIG. 10 is an example of a timing chart illustrating an output method of the ignition signal SA according to an elapsed time after dielectric breakdown.

In FIG. 10, upper, middle and lower figures are the same as those of the timing chart illustrated in FIG. 5, respectively. That is, the upper figure illustrates ON/OFF of the ignition signal SA output from the ignition control unit 83 to the ignition coil 300. A middle figure illustrates a discharge voltage of the ignition coil 300, that is, a voltage applied between the center electrode 210 and the outer electrode 220 of the spark plug 200 from the secondary coil 320 of the ignition coil 300. A lower figure illustrates a discharge current of the ignition coil 300, that is, a current flowing through the secondary coil 320 of the ignition coil 300 and the spark plug 200 according to the discharge voltage. Further, times T1 to T5 are the same as those of the timing chart illustrated in FIG. 5. That is, the time T1 indicates the charge start time, the time T2 indicates the start time of the corona discharge, the time T3 indicates the ignition time, the time T4 indicates the end time of pulse width modulation during the arc discharge period, and the time T5 indicates the end time of the arc discharge, respectively.

In the case of FIG. 10, as illustrated in the lower figure, the ignition control unit 83 gradually increases the arc discharge current target value IA according to an elapsed time after the dielectric breakdown, that is, an elapsed time after starting the arc discharge. As a result, even when the discharge path extends due to the flow of the air-fuel mixture in the cylinder 150 or the like, the arc discharge can be stably continued. It should be noted that the arc discharge current target value IA can be defined (calculated) using, for example, an arbitrary polynomial.

Here, during the period from the time T3 to the time T4, similarly to the case of FIG. 9, the interruption (short circuit) of the arc discharge occurs. In this case, the ignition control unit 83 discontinuously increases the arc discharge current target value IA, as illustrated in the lower figure, and then performs modification to continuously increase the arc discharge current target value IA as before the interruption. As a result, the arc discharge is restarted, and the subsequent arc discharge can be continued stably. The modification of the arc discharge current target value IA can be realized by modifying the polynomial that defines the arc discharge current target value IA. For example, when the arc discharge current target value IA is defined by a first-order polynomial, the arc discharge current target value IA can be modified as described above by modifying slope and intercept (initial value) of the equation. Further, in the next and subsequent cycles, the modified arc discharge current target value IA may be used.

According to the first embodiment of the present invention described above, the following operational effects are exhibited.

(1) The control device 1 for an internal combustion engine includes the ignition control unit 83 that controls energization of the ignition coil 300 that applies electric energy to the spark plug 200 that discharges in the cylinder 150 of the internal combustion engine 100 to ignite the fuel. The ignition control unit 83 continuously transmits the first pulse signal (pulse signal for corona discharge) to the igniter 340 connected to the ignition coil 300 before the dielectric breakdown between the electrodes of the spark plug 200, and continuously transmits the second pulse signal (pulse signal for arc discharge) to the igniter 340 after the dielectric breakdown between the electrodes of the spark plug 200 to control the energization of the ignition coil 300. At this time, the period of the pulse signal for corona discharge is shorter than the period of the pulse signal for arc discharge. Accordingly, it is possible to suppress the failure of ignition of the fuel caused by the spark plug 200 while suppressing the wear of the electrodes of the spark plug 200 in the internal combustion engine 100.

(2) The ignition control unit 83 performs pulse width modulation on the pulse signal for corona discharge so that the discharge voltage of the ignition coil 300 approaches the predetermined voltage target value (corona discharge voltage target value VC) before the dielectric breakdown (before time T3) between the electrodes of the spark plug 200 and transmits the modulated pulse signal (Step S107). Further, the ignition control unit 83 performs the pulse width modulation on the pulse signal for arc discharge so that a discharge current of the ignition coil 300 approaches the predetermined current target value (arc discharge current target value IA) after the dielectric breakdown (after time T3) between the electrodes of the spark plug 200 and transmits the modulated pulse signal (Step S111). Accordingly, it is possible to output an optimum pulse signal before and after the dielectric breakdown to control the discharge of the ignition coil 300.

(3) The corona discharge voltage target value VC is set to be smaller than the dielectric breakdown voltage between the electrodes of the spark plug 200. Therefore, it is possible to prevent the dielectric breakdown from occurring during the corona discharge period before the ignition time T3 and erroneous ignition from occurring.

(4) The ignition control unit 83 can set the corona discharge voltage target value VC based on the dielectric breakdown voltage detected when the spark plug 200 is discharged in the past (Step S102). Therefore, it is possible to set the optimum corona discharge voltage target value VC according to the operation state of the internal combustion engine 100 or the state of the air-fuel mixture in the cylinder 150.

(5) The ignition control unit 83 can set the arc discharge current target value IA based on at least one of the operation state of the internal combustion engine 100, the state of the electrode of the spark plug 200, and the state of the air-fuel mixture in the cylinder 150 of the internal combustion engine 100 (Step S103). Accordingly, it is possible to set the optimum arc discharge current target value IA according to these various setting conditions.

(6) As described in FIG. 9, the ignition control unit 83 may increase the arc discharge current target value IA when the discharge is interrupted after the dielectric breakdown between the electrodes of the spark plug 200. Accordingly, the arc discharge after restart can be stably continued.

(7) As described in FIG. 10, the ignition control unit 83 may gradually increase the arc discharge current target value IA according to the elapsed time after the dielectric breakdown between the electrodes of the spark plug 200. Therefore, even when the discharge path extends during the arc discharge, the arc discharge can be stably continued.

(8) The ignition coil 300 has the primary coil 310 through which the primary current flows and the secondary coil 320 that generates a voltage between the electrodes of the spark plug 200 when the primary current is energized and cut off. The ignition control unit 83 controls the energization and cutting off of the primary current using the pulse signal for corona discharge and the pulse signal for arc discharge so as to control the voltage generated between the electrodes of the spark plug 200 by the secondary coil 320 and the current flowing through the secondary coil 320. Therefore, the energization of the ignition coil 300 can be reliably and easily controlled according to the spark plug 200.

(9) The control device 1 for the internal combustion engine includes the ignition control unit 83 that controls the energization of the ignition coil 300 that applies electric energy to the spark plug 200 that discharges in the cylinder 150 of the internal combustion engine 100 to ignite the fuel. The ignition control unit 83 controls the energization of the ignition coil 300 so that the predetermined voltage (corona discharge voltage target value VC) smaller than the dielectric breakdown voltage occurs between the electrodes of the spark plug 200 before the dielectric breakdown between the electrodes of the spark plug 200, and the predetermined current (arc discharge current target value IA) flows through the spark plug 200 after the dielectric breakdown between the electrodes of the spark plug 200. Accordingly, it is possible to suppress the failure of ignition of the fuel caused by the spark plug 200 while suppressing the wear of the electrodes of the spark plug 200 in the internal combustion engine 100.

Second Embodiment

Hereinafter, a control device for an internal combustion engine according to a second embodiment of the present invention will be described. In the second embodiment, an example of estimating the flow velocity of the air-fuel mixture in the cylinder 150 of the internal combustion engine 100 based on the discharge current or the discharge voltage of the spark plug 200 detected during the corona discharge or the arc discharge will be described. Since the configuration of the internal combustion engine 100 or the hardware configuration of the control device 1 according to the second embodiment is the same as that of the first embodiment, descriptions thereof will be omitted below.

[Functional Block of Control Device]

Figure 11:
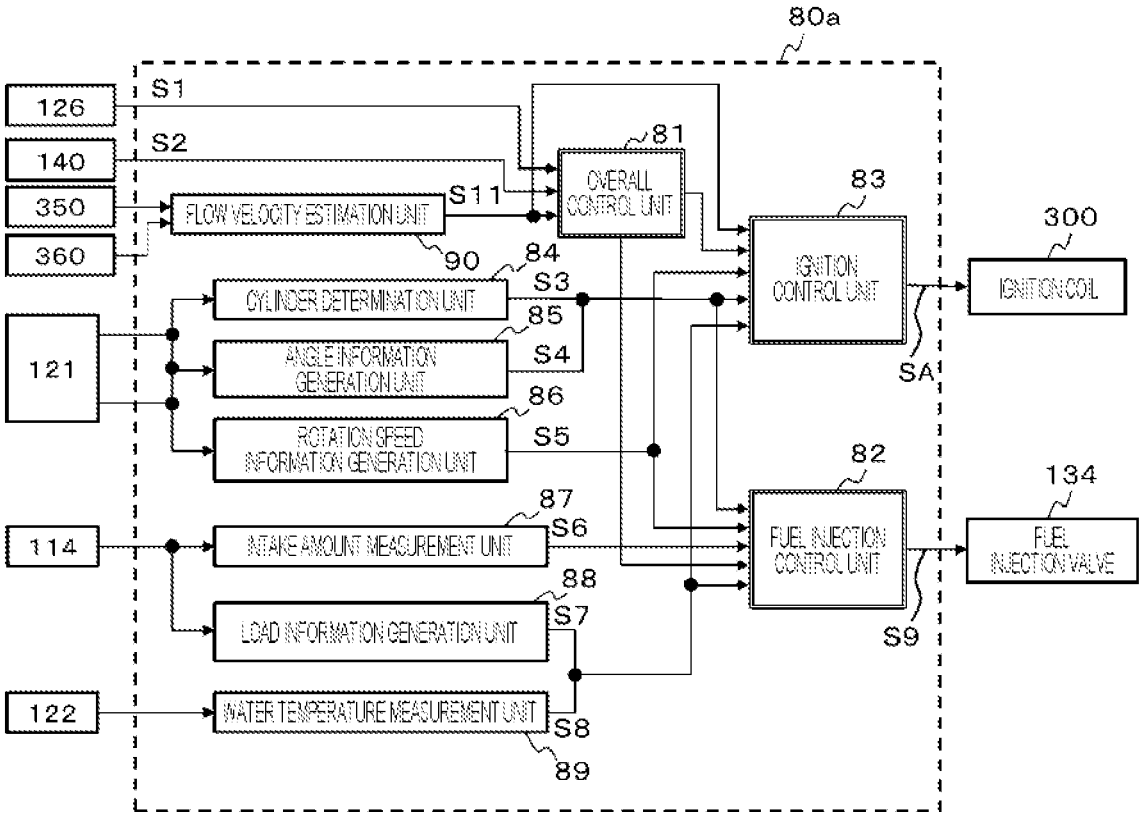
FIG. 11 is a functional block diagram illustrating a functional configuration of a control device according to a second embodiment.

FIG. 11 is a functional block diagram illustrating a functional configuration of the control device 1 according to the second embodiment. For example, each function of the control device 1 is realized by an output circuit 80*a* when the MPU 50 executes a control program stored in the ROM 60. In the control device 1 according to the second embodiment, the output circuit 80*a* illustrated in FIG. 11 is provided in place of the output circuit 80 illustrated in FIG. 3 in the first embodiment.

As illustrated in FIG. 11, the output circuit 80*a* of the control device 1 according to the second embodiment further has a flow velocity estimation unit 90 in addition to the functional blocks described in FIG. 3. The flow velocity estimation unit 90 has a function of inputting the charge amount of the ignition coil 300 detected by the charge amount detection unit 350 and the discharge current or discharge voltage of the spark plug 200 detected by the discharge amount detection unit 360 and estimating the flow velocity of the air-fuel mixture in each cylinder 150 based on these values. Flow velocity information S11 from the flow velocity estimation unit 90 is input to the overall control unit 81 and used in control of the fuel injection control unit 82 or the ignition control unit 83 performed by the overall control unit 81, and input to the ignition control unit 83 and used for the discharge control (ignition control) of the spark plug 200 performed by the ignition control unit 83.

[Electric Circuit of Ignition Coil]

Figure 12:
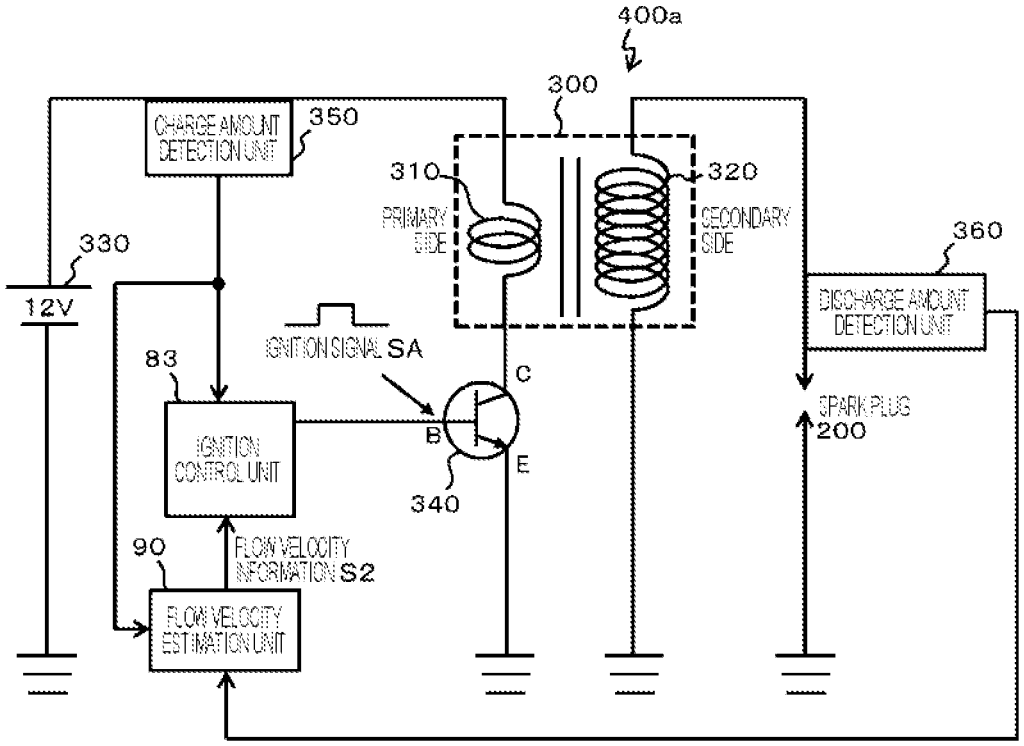
FIG. 12 is a diagram illustrating an electric circuit including an ignition coil according to the second embodiment.
Figure 13A:
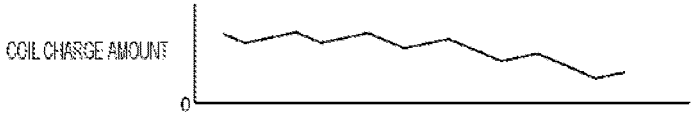
FIGS. 13A-13H are diagrams a diagram illustrating an example of a flow velocity estimation method according to the second embodiment.
Figure 13B:
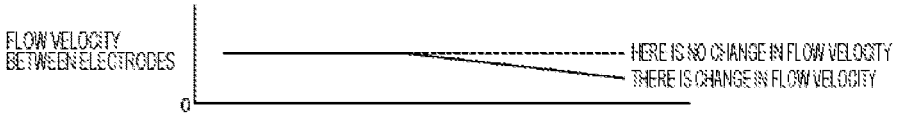
Figure 13C:
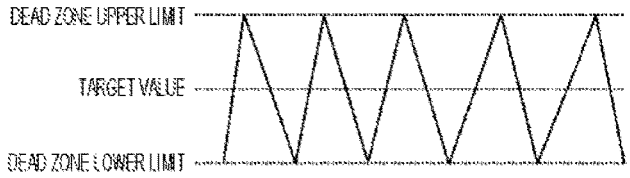
Figure 13D:
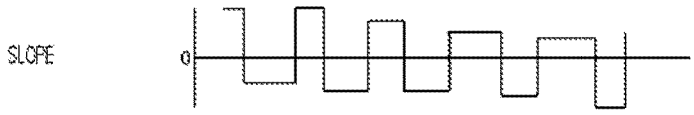
Figure 13E:
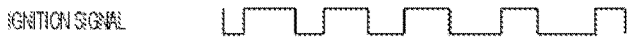
Figure 13F:
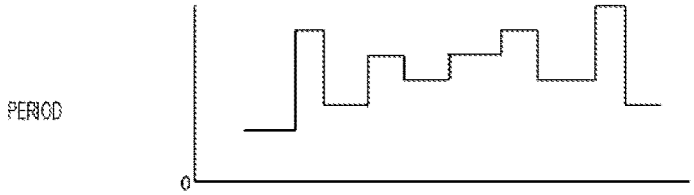
Figure 13G:
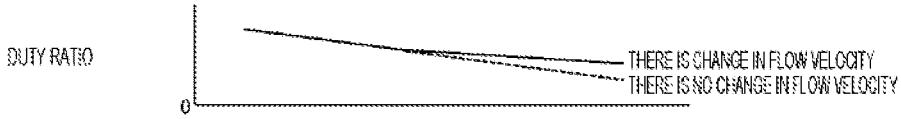
Figure 13H:
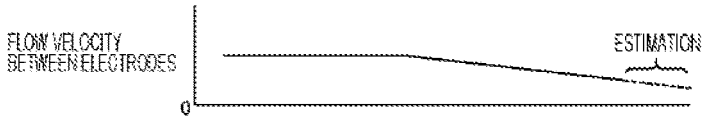

FIG. 12 is a diagram illustrating an electric circuit 400*a* including the ignition coil 300 according to the second embodiment. In the second embodiment, the electric circuit 400*a* illustrated in FIG. 12 is provided in place of the electric circuit 400 illustrated in FIG. 4 in the first embodiment.

As illustrated in FIG. 12, the electric circuit 400*a* according to the second embodiment further includes the flow velocity estimation unit 90 in addition to the components described in FIG. 4. The flow velocity estimation unit 90 acquires the voltage and current of the primary coil 310 detected by the charge amount detection unit 350 and the discharge current or discharge voltage of the spark plug 200 detected by the discharge amount detection unit 360. Then, the flow velocity estimation unit 90 calculates the flow velocity of the air-fuel mixture in the cylinder 150 based on these acquired values and outputs a calculation result to the ignition control unit 83 as the flow velocity information S11. The ignition control unit 83 controls the discharge of the spark plug 200 by controlling the ignition signal SA output to the igniter 340 based on the input flow velocity information S11.

[Outline of Flow Velocity Estimation]

Next, an outline of the flow velocity estimation of the air-fuel mixture in the cylinder 150 according to the second embodiment will be described.

In the cylinder 150, in a case where the flow velocity of the air-fuel mixture changes when the corona discharge or arc discharge is performed between the electrodes of the spark plug 200, the discharge path between the electrodes changes, and an energization distance changes accordingly. Therefore, a resistance value between the electrodes changes, and a ratio of the discharge current to the discharge voltage changes accordingly. Meanwhile, an output voltage of the ignition coil 300 changes depending on the charge amount. Therefore, when the flow velocity of the air-fuel mixture changes during the corona discharge or arc discharge, the discharge current of the spark plug 200 or a quotient obtained by dividing the discharge current by the discharge voltage changes.

Here, the quotient obtained by dividing the discharge current by the discharge voltage corresponds to the resistance value between the electrodes of the spark plug 200.

In the second embodiment, the above relationship is used to estimate the flow velocity of the air-fuel mixture in the cylinder 150 during the corona discharge or arc discharge. That is, the discharge current for each charge amount of the ignition coil 300 or the quotient obtained by dividing the discharge current by the discharge voltage when the flow velocity of the air-fuel mixture is constant is obtained in advance, and the flow velocity of the air-fuel mixture is estimated from deviations between these and an actual measurement value.

Hereinafter, a specific example of estimating the flow velocity of the air-fuel mixture in the cylinder 150 according to the second embodiment will be described with reference to FIG. 13.

FIG. 13 is a diagram illustrating an example of the flow velocity estimation method according to the second embodiment. FIG. 13(*a*) illustrates the charge amount of the ignition coil 300, and FIG. 13(*b*) illustrates the flow velocity of the air-fuel mixture between the electrodes of the spark plug 200. FIG. 13(*c*) illustrates the discharge voltage or the discharge current, and FIG. 13(*d*) illustrates a slope of the discharge voltage or the discharge current. FIG. 13(*e*) illustrates ON/OFF of the ignition signal SA, FIG. 13(*f*) illustrates the period of the ignition signal SA, and FIG. 13(*g*)

illustrates a duty ratio of the ignition signal SA. FIG. 13(*h*) illustrates an estimation result of the flow velocity of the air-fuel mixture between the electrodes of the spark plug 200.

As described in the first embodiment, the pulse width of the ignition signal SA output during the corona discharge or arc discharge is adjusted by the pulse width modulation, and thus, for example, the charge amount of the ignition coil 300 is changed as illustrated in FIG. 13(*a*). The charge amount of the ignition coil 300 at each time point can be calculated by calculating differences between the charge amount obtained from a product of the voltage and current detected by the charge amount detection unit 350 and the discharge amount obtained from a product of the voltage and current detected by the discharge amount detection unit 360, and integrating the differences.

In the pulse width modulation of the ignition signal SA, the ignition control unit 83 performs the ignition control so that the discharge voltage approaches the corona discharge voltage target value VC during the corona discharge, or the discharge current approaches the arc discharge current target value IA during the arc discharge. At this time, as illustrated in FIG. 13(*c*), the ignition control unit 83 provides a dead zone having a predetermined width about a target value (corona discharge voltage target value VC or arc discharge current target value IA), and modulates the pulse width of the ignition signal SA so that the discharge voltage or discharge current is within this dead zone. As a result, the pulse width of the ignition signal SA changes as illustrated in FIG. 13(*e*). This pulse width is determined by a width of the dead zone illustrated in FIG. 13(*c*) and the slope of the change in the discharge voltage or discharge current. Here, it is preferable that the width of the dead zone is set to a predetermined value and is not changed during the pulse width modulation.

Meanwhile, the slope of the discharge voltage or discharge current illustrated in FIG. 13(*c*) changes for each pulse of the ignition signal SA. The change in the slope is illustrated in FIG. 13(*d*). Here, the slope of the discharge voltage or the discharge current changes mainly due to the influence of the charge amount of the ignition coil 300 and the flow velocity of the air-fuel mixture between the electrodes of the spark plug 200. That is, the pulse width of the ignition signal SA is mainly determined by the charge amount of the ignition coil 300 and the flow velocity of the air-fuel mixture between the electrodes of the spark plug 200.

From the width of each pulse of the ignition signal SA illustrated in FIG. 13(*e*), the period of the ignition signal SA is obtained for each pulse as illustrated in FIG. 13(*f*). In FIG. 13(*f*), there is a delay of one pulse with respect to FIG. 13(*e*). From the period of each pulse, the duty ratio of the ignition signal SA can be obtained as illustrated in FIG. 13(*g*).

Here, as illustrated by a broken line in FIG. 13(*b*), when there is no change in the flow velocity of the air-fuel mixture, the resistance value between the electrodes of the spark plug 200 is constant. Therefore, as illustrated by a broken line in FIG. 13(*g*), the duty ratio of the ignition signal SA changes according to the charge amount of the ignition coil 300. Meanwhile, as illustrated by a solid line in FIG. 13(*b*), when the flow velocity of the air-fuel mixture changes in a decreasing direction, the resistance value between the electrodes of the spark plug 200 also changes in the decreasing direction. Therefore, as illustrated by a solid line in FIG. 13(*g*), the duty ratio of the ignition signal SA is larger than that when there is no change in the flow velocity. When the charge amount and the discharge amount at the time of output of each pulse of the ignition signal SA are constant and there is no change in the flow velocity of the air-fuel mixture, the duty ratio of the ignition signal SA is constant.

The flow velocity estimation unit 90 obtains the duty ratio of the ignition signal SA according to the change of the discharge voltage or the discharge current as described above, and obtains an amount of deviation between a theoretical value and an actual measurement value of the duty ratio with respect to the charge amount of the ignition coil 300 by comparing this duty ratio with a map information illustrating a relationship between the charge amount and the duty ratio acquired in advance under a predetermined flow velocity condition. The amount of deviation indicates an influence of the flow velocity of the air-fuel mixture between the electrodes of the spark plug 200. Therefore, the flow velocity estimation unit 90 can estimate the flow velocity of the air-fuel mixture from the amount of deviation by a method such as substituting the obtained amount of deviation into a preset approximate expression. The relationship between the charge amount and the duty ratio indicated by the map information corresponds to the relationship of the discharge current or the quotient obtained by dividing the discharge current by the discharge voltage with respect to the charge amount.

Further, the flow velocity estimation unit 90 can also estimate a future flow velocity of the air-fuel mixture based on a change in the flow velocity of the air-fuel mixture estimated so far. For example, as illustrated in FIG. 13(*h*), when flow velocity estimation results obtained so far continue to decrease at a constant rate, an extension line illustrated by a broken line can be obtained as the estimation result of the future air-fuel mixture.

[Control Method of Ignition Coil]

Figure 14:
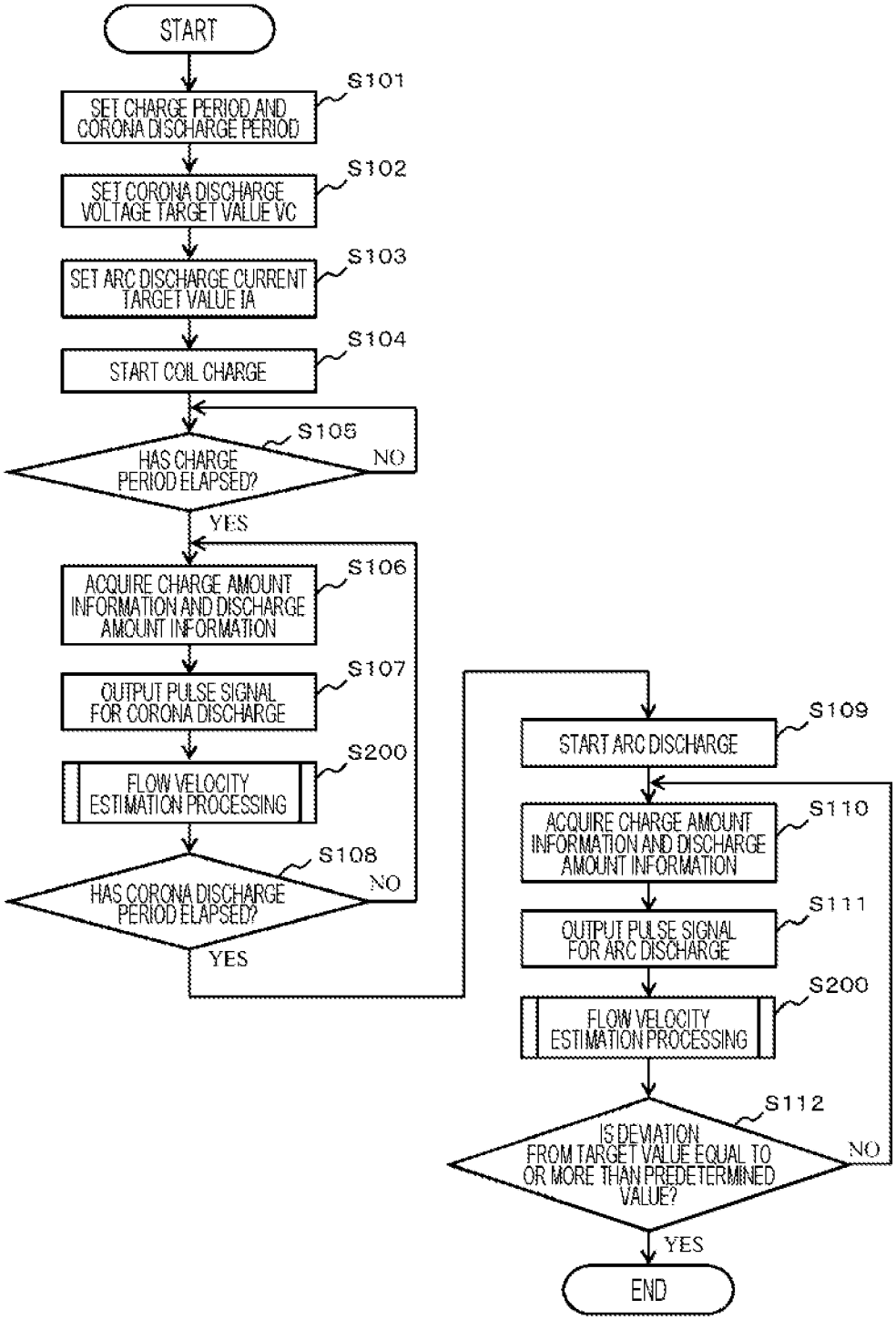
FIG. 14 is an example of a flowchart illustrating a control method of the ignition coil according to the second embodiment.

FIG. 14 is an example of a flowchart illustrating a control method of the ignition coil 300 according to the second embodiment. In the second embodiment, the ignition control unit 83 performs the same processing as the flowchart of FIG. 7 described in the first embodiment in Steps S101 to S112, respectively. Further, between Steps S107 and S108 and between Steps S111 and S112, the flow velocity estimation unit 90 performs flow velocity estimation processing illustrated in FIG. 15, respectively.

Figure 15:
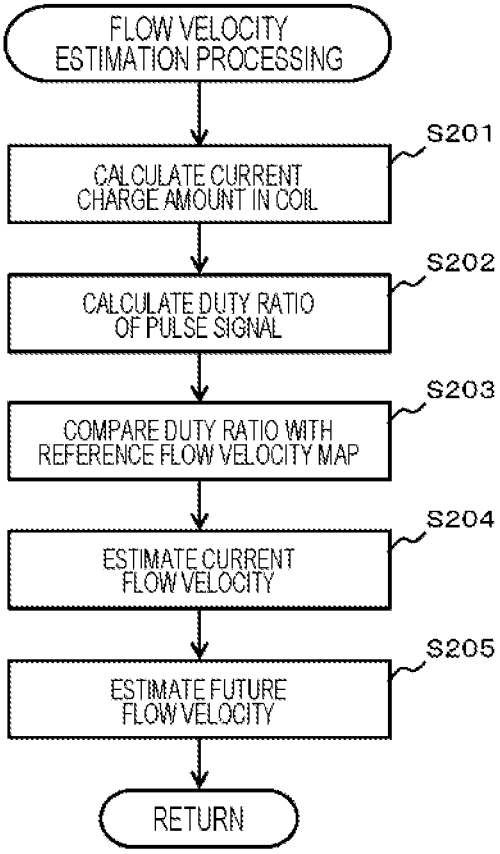
FIG. 15 is an example of a flowchart illustrating flow velocity estimation processing.

FIG. 15 is an example of a flowchart illustrating the flow velocity estimation processing performed in Step S200.

In Step S201, the flow velocity estimation unit 90 calculates a current charge amount in the ignition coil 300. Here, by calculating the charge amount and the discharge amount using the voltage and current information of the primary coil 310 detected by the charge amount detection unit 350 and the voltage and current information of the secondary coil 320 detected by the discharge amount detection unit 360, and integrating differences therebetween from the start of charging to the present, the current charge amount in the ignition coil 300 is calculated.

In Step S202, the flow velocity estimation unit 90 calculates the duty ratio of the pulse signal output by the ignition control unit 83 as the ignition signal SA. Here, as described above, the duty ratio of the ignition signal SA is calculated by obtaining the period of the ignition signal SA from the width of each pulse of the ignition signal SA.

In Step S203, the flow velocity estimation unit 90 compares the duty ratio calculated in Step S202 with a predetermined reference flow velocity map. The reference flow velocity map to be compared here is map information indicating the relationship between the charge amount and the duty ratio acquired in advance under a predetermined flow velocity condition, and is stored in the ROM 60 in the control device 1. At this time, the flow velocity estimation unit 90 refers to the theoretical value of the duty ratio corresponding to the current charge amount in the ignition coil 300 in the reference flow velocity map based on the charge amount calculated in Step S201, and calculates a difference between the theoretical value and the actual measurement value of the duty ratio calculated in Step S202.

In Step S204, the flow velocity estimation unit 90 estimates the current flow velocity of the air-fuel mixture between the electrodes of the spark plug 200 based on a comparison result of Step S203. Here, the current flow velocity with respect to the reference flow velocity is estimated from the difference between the theoretical value and the actual measurement value of the duty ratio obtained in Step S203 using a preset function or the like. In Step S204, the estimation result of the flow velocity during the corona discharge or arc discharge can be obtained for each pulse based on the duty ratio obtained for each pulse of the ignition signal SA.

In Step S205, the flow velocity estimation unit 90 estimates the future flow velocity of the air-fuel mixture based on the current flow velocity of the air-fuel mixture estimated in Step S204. Here, the future flow velocity estimation result is obtained from a history of the flow velocity estimation result obtained in Step S204. For example, an approximate straight line or an approximate curve corresponding to the flow velocity estimation results so far is obtained, and the flow velocity estimation result can be obtained at an arbitrary time in the future can be obtained by using the approximate straight line or approximate curve.

After performing the processing of Step S205, the flow velocity estimation unit 90 ends the flow velocity estimation processing of FIG. 15, and proceeds to Step S108 or S112 of FIG. 14.

As described above, the flow velocity estimation unit 90 estimates the flow velocity of the air-fuel mixture in the cylinder 150 during the corona discharge or arc discharge. This flow velocity estimation result can be used for ignition control of the ignition control unit 83. Specifically, for example, when the flow velocity estimated in Step S204 deviates greatly from the target value and therefore it is determined that ignition is difficult, the charge period or ignition time in the next and subsequent cycles is set based on the future flow velocity estimation result estimated in Step S205. In this way, the air-fuel mixture can be combusted more stably and high thermal efficiency can be obtained.

The method for estimating the flow velocity of the air-fuel mixture described above can be performed regardless of presence or absence of the arc discharge and the charge amount of the ignition coil 300. Therefore, it is possible to continuously detect the gas flow velocity between the electrodes regardless of an operation stroke (compression step or expansion stroke) of the internal combustion engine 100 or flammability of the gas between the electrodes of the spark plug 200. Therefore, it is possible to repeat the detection in a short period of time during the charging/discharging of the ignition coil 300, and it is possible to realize highly accurate and stable flow velocity detection. The discharge current or discharge voltage in the corona discharge or arc discharge is affected by a distance between the electrodes, an electrode shape, a gas pressure, a gas temperature, an electrode temperature, a gas composition, a gas humidity, or the like, in addition to the charge amount of the ignition coil 300 and the gas flow velocity between the electrodes of the spark plug 200. Therefore, it is desirable to detect the discharge current and the discharge voltage under a condition that the change other than the flow velocity is as small as possible.

According to the second embodiment of the present invention described above, in addition to the ones described in the first embodiment, the following operational effects are further exerted.

(10) The control device 1 for the internal combustion engine includes the flow velocity estimation unit 90 that estimates the flow velocity of the air-fuel mixture in the cylinder 150 of the internal combustion engine 100. The flow velocity estimation unit 90 estimates the flow velocity based on at least one of the discharge current and the discharge voltage of the spark plug 200 that discharges in the cylinder 150 to ignite the fuel. Accordingly, it is possible to estimate the flow velocity of the air-fuel mixture with high accuracy regardless of the state of the internal combustion engine 100 and the state of the air-fuel mixture in the cylinder 150. Therefore, it is possible to suppress the failure of ignition of the fuel caused by the spark plug 200 using this estimation result.

(11) The flow velocity estimation unit 90 continuously estimates the flow velocity of the air-fuel mixture based on at least one of the discharge voltage (discharge voltage during corona discharge) before the dielectric breakdown and the discharge current (discharge current during arc discharge) after the dielectric breakdown between the electrodes of the spark plug 200. Accordingly, the flow velocity of the air-fuel mixture can be estimated at any timing during both the corona discharge period and the arc discharge period.

(12) The ignition coil 300 is connected to the spark plug 200, and the ignition coil 300 is energized and controlled using the pulse signal whose pulse width is modulated based on the discharge current or the discharge voltage. The flow velocity estimation unit 90 estimates the flow velocity of the air-fuel mixture based on the duty ratio of this pulse signal (Steps S202 to S204). Therefore, the flow velocity of the air-fuel mixture can be estimated accurately and easily using the pulse width-modulated ignition signal SA.

(13) The flow velocity estimation unit 90 estimates the future flow velocity of the air-fuel mixture based on the change in the estimated flow velocity of the air-fuel mixture (Step S205). Therefore, it is possible to estimate the future flow velocity in addition to the current flow velocity.

(14) The control device 1 includes the ignition control unit 83 that controls the discharge of the spark plug 200 based on the future flow velocity of the air-fuel mixture estimated by the flow velocity estimation unit 90. Therefore, it is possible to control the discharge of the spark plug 200 more appropriately.

In the second embodiment described above, the example of estimating the flow velocity of the air-fuel mixture by the flow velocity estimation unit 90 in addition to the ignition control described in the first embodiment is described. However, but these may be performed separately. As long as at least the pulse width modulation is performed on the ignition signal SA and the modulated ignition signal SA is output, the flow velocity estimation unit 90 can estimate the flow velocity of the air-fuel mixture.

Moreover, in each embodiment described above, each functional configuration of the control device 1 described in FIG. 3 or 11 may be realized by software executed by the MPU 50 as described above, or may be realized by hardware such as a Field-Programmable Gate Array (FPGA). In addition, these may be mixed and used.

In each embodiment described above, the example of realizing the discharge voltage and the discharge current illustrated in FIGS. 5, 8, 9, and 10, respectively, by controlling the ignition of the spark plug 200 using one ignition coil 300 is described. However, a plurality of ignition coils 300 may be used in combination.

For example, the ignition signal SA generated by the pulse width modulation described in each of the first and second embodiments is output from the ignition control unit 83 to the igniter 340 connected to at least one ignition coil 300 of the plurality of ignition coils 300, and the conventional ignition signal SA which is not subjected to the pulse width modulation is output from the ignition control unit 83 to the igniters 340 connected to the other ignition coils 300. Then, by synthesizing (superimposing) the electric energy emitted from the ignition coils 300 and supplying the synthesized electric energy to the spark plug 200, it is possible to realize any discharge voltage waveform and discharge current waveform including the discharge voltage and discharge current illustrated in FIGS. 5, 8, 9, and 10, respectively. The ignition signal SA generated by the pulse width modulation may be output to the igniters 340 connected to all the ignition coils 300.

The embodiments and various modification examples described above are merely examples, and the present invention is not limited to these contents unless the characteristics of the invention are impaired. Moreover, although various embodiments and modification examples are described above, the present invention is not limited to these contents. Other modes considered within a scope of a technical idea of the present invention are also included in the scope of the present invention.

REFERENCE SIGNS LIST

1 control device
10 analog input unit
20 digital input unit
30 A/D conversion unit
40 RAM
50 MPU
60 ROM
70 I/O port
80, 80*a* output circuit
81 overall control unit
82 fuel injection control unit
83 ignition control unit
84 cylinder determination unit
85 angle information generation unit
86 rotation speed information generation unit
87 intake amount measurement unit
88 load information generation unit
89 water temperature measurement unit
90 flow velocity estimation unit
100 internal combustion engine
110 air cleaner
111 intake pipe
112 intake manifold
113 throttle valve
113*a* throttle opening sensor
114 flow rate sensor
115 intake air temperature sensor
120 ring gear
121 crank angle sensor
122 water temperature sensor
123 crankshaft
125 accelerator pedal
126 accelerator position sensor
130 fuel tank
131 fuel pump
132 pressure regulator
133 fuel pipe
134 fuel injection valve
140 combustion pressure sensor
150 cylinder
151 intake valve
152 exhaust valve
160 exhaust manifold
161 three-way catalyst
162 upstream-side air-fuel ratio sensor
163 downstream-side air-fuel ratio sensor
170 piston
200 spark plug
210 center electrode
220 outer electrode
230 insulator
300 ignition coil
310 primary coil
320 secondary coil
330 DC power supply
340 igniter
350 charge amount detection unit
360 discharge amount detection unit
400, 400*a* electric circuit

The invention claimed is:

1. A control device for an internal combustion engine comprising:

an ignition control unit that controls energization of an ignition coil that applies electric energy to a spark plug that discharges in a cylinder of the internal combustion engine to ignite a fuel, wherein the ignition control unit continuously transmits a first pulse signal to an igniter connected to the ignition coil before dielectric breakdown between electrodes of the spark plug, and continuously transmits a second pulse signal to the igniter after the dielectric breakdown between the electrodes of the spark plug to control the energization of the ignition coil, and a period of the first pulse signal is shorter than a period of the second pulse signal, the continuous transmission is carried out with pulse width modulation including ON and OFF periods so that the signal is transmitted with gaps or interruptions, the igniter is a transistor;

the ignition control unit performs pulse width modulation on the first pulse signal so that a discharge voltage of the ignition coil approaches a predetermined voltage target value before a partial dielectric breakdown between the electrodes of the spark plug during a period corresponding to the first pulse signal and transmits the modulated first pulse signal, and the ignition control unit performs the pulse width modulation on the second pulse signal so that a discharge current of the ignition coil approaches a predetermined current target value after the dielectric breakdown between the electrodes of the spark plug and transmits the modulated second pulse signal.

2. The control device for the internal combustion engine according to claim 1, wherein the predetermined voltage target value is set to be smaller than a dielectric breakdown voltage between the electrodes of the spark plug.

3. The control device for the internal combustion engine according to claim 2, wherein the ignition control unit sets the predetermined voltage target value based on the dielectric breakdown voltage detected when the spark plug is discharged.

4. The control device for internal combustion engine according to claim 1, wherein the ignition control unit sets the predetermined current target value based on at least one of an operation state of the internal combustion engine, a state of the electrodes of the spark plug, and a state of an air-fuel mixture in the cylinder of the internal combustion engine.

5. The control device for the internal combustion engine according to claim 1, wherein the ignition control unit increases the predetermined current target value when discharge is interrupted after the dielectric breakdown between the electrodes of the spark plug.

6. The control device for the internal combustion engine according to claim 1, wherein the ignition control unit gradually increases the predetermined current target value according to an elapsed time after the dielectric breakdown between the electrodes of the spark plug.

7. The control device for the internal combustion engine according to claim 1, wherein the ignition coil has a primary coil through which a primary current flows and a secondary coil that generates a voltage between the electrodes of the spark plug when the primary current is energized and cut off, and the ignition control unit controls the energization and cutting off of the primary current using the first pulse signal and the second pulse signal so as to control the voltage generated between the electrodes of the spark plug by the secondary coil and a current flowing through the secondary coil.

* * * * *